US006518407B1

(12) United States Patent
Brock et al.

(10) Patent No.: US 6,518,407 B1
(45) Date of Patent: Feb. 11, 2003

(54) REACTIVE DYE COMPOUND COMPRISING AT LEAST ONE CHROMOPHORE MOIETY AND AT LEAST ONE NITROGEN-CONTAINING HETEROCYCLE

(75) Inventors: Earl David Brock, West Chester, OH (US); David Malcolm Lewis, Otley (GB); Taher Iqbal Yousaf, Egham (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/647,580

(22) PCT Filed: Apr. 1, 1999

(86) PCT No.: PCT/US99/07293

§ 371 (c)(1),
(2), (4) Date: Feb. 13, 2001

(87) PCT Pub. No.: WO99/51685

PCT Pub. Date: Oct. 14, 1999

(51) Int. Cl.[7] ..... C09B 62/026; C09B 62/08; D06P 1/382

(52) U.S. Cl. ..... 534/604; 534/603; 534/605; 534/606; 534/607; 534/612; 8/547

(58) Field of Search ..... 534/603, 604, 534/605, 612; 8/547

(56) References Cited

U.S. PATENT DOCUMENTS 3,116,275 A 12/1963 Gamlen et al. ..... 534/605

FOREIGN PATENT DOCUMENTS

| | | |
|---|---|---|
| DE | 14 44 295 A | 10/1968 |
| EP | 0 260 806 A2 | 3/1988 |
| EP | 0 735 107 A2 | 9/1990 |
| EP | 0 418 623 A1 | 3/1991 |

OTHER PUBLICATIONS

Lehr, F., "Synthesis and Application of Reactive Dyes with Heterocyclic Reactive Systems," Dyes and Pigments, vol. 14, No. 4, Jan. 1990, pp. 239–263.

*Primary Examiner*—Fiona T. Powers
(74) *Attorney, Agent, or Firm*—Brent M. Peebles

(57) ABSTRACT

A novel reactive dye compound is disclosed. It comprises (a) at least one chromophore moiety; (b) at least one nitrogen-containing heterocycle; (c) a linking group to link each chromophore moiety to each nitrogen-containing heterocycle; characterised in that at least one nitrogen-containing heterocycle is substituted with at least one thio-derivative and at least one quaternized nitrogen derivative.

38 Claims, No Drawings

REACTIVE DYE COMPOUND COMPRISING AT LEAST ONE CHROMOPHORE MOIETY AND AT LEAST ONE NITROGEN-CONTAINING HETEROCYCLE

TECHNICAL FIELD

The present invention relates to reactive dye compounds. In particular the present invention relates to reactive dye compounds having improved dye-bath Exhaustion (E) and improved dye-fibre covalent Fixation (F).

BACKGROUND OF THE INVENTION

Reactive dye compounds are known in the art for dyeing various substrates. Such substrates include for example proteinaceous materials such as keratin, e.g. found in hair, skin and nails and various animal body parts such as horns, hooves and feathers, and other naturally occurring protein containing materials, e.g. silk and saccharide-derived materials such as those derived from cellulose or cellulose derivatives, e.g. natural products such as cotton, and synthetic fibres such as polyamides.

Examples of classes of such reactive dyes which are well known in the art include dyes containing a mono- or dichloro- or fluoro-1,3,5-triazinyl group, mono- or dichloro or fluoro-pyrimidyl group, beta-halogen-propionyl group, beta-halogenoethyl-sulphonyl group, beta-halogenoethylsulphamyl group, chloroacetyl amino, beta-(chloro-methyl)-beta-sulphatoethylsulphamyl group, or a vinyl sulphonyl group.

In the case of the dyes containing a triazinyl group or a pyrimidyl group, in place of the reactive halogen atoms one can use other groups which dissociate in the presence of alkali. Canadian Patent 771632, for example, discloses examples of such other groups including sulphonic acid, thiocyanate, sulphophenoxy, sulphophenyl thio, nitrosulphophenoxy groups, and quaternary ammonium groups.

Dyes and Pigments 14, 1990, pages 239–263, "Synthesis and Application of Reactive Dyes with Heterocyclic Reactive Systems" discloses fibre reactive dyes containing monochloro- or dichloro- pyrimidine heterocycle with quaternary ammonium substituents.

There are many different types of commercially-available reactive dyes for dyeing cellulosic and polyamide-type substrates. However, a critical problem still facing the textile dye industry today is the significant level of dyestuff material which remains in the effluent waste water after the dyeing process is finished. The industry measure for this problem is known as dye-bath Exhaustion (E). A high Exhaustion value for a particular dye compound means that a low level of spent dye remains in the effluent after the dyeing process is complete, while a low Exhaustion value means that a high level of spent dye remains in the effluent. There is clearly a need therefore for new dye compounds which have higher Exhaustion Values compared with commercially available dye compounds, and which provide benefits in terms of reducing levels of spent dyestuff in effluent water.

As well as having a high Exhaustion Value, it is also important for a dye compound to have a high dye-fibre covalent Fixation Value (F). The Fixation Value (F) of a reactive dye compound is a measure of the extent of covalent bonding with the substrate based on the dye originally absorbed during the dyeing process. Thus 100% Fixation means that 100% of the dye covalently bonds to the substrate. Thus, there is clearly a need to provide dye compounds having increased Fixation Values. A high Fixation Value can result in a simplification of the post dyeing "soaping off process" traditionally associated with fiber reactive dye compounds. In particular, a high Fixation Value can result in a reduced time spent on the "soaping off process" together with a reduced cost.

It has now been surprisingly found that a new class of fibre reactive dye compounds comprising a nitrogen-containing heterocycle substituted with at least one thio-derivative, such as thioglycolate, and at least one quaternized nitrogen derivative, such as nicotinate, exhibit significantly increased values of Exhaustion (E) and Fixation (F). These dyes can be used on a wide variety of substrates. They are particularly useful for cellulosic substrates, such as cotton, and show significant improvements in terms of reducing spent dyestuff in effluent, increasing dye affinity to the substrate, increasing the efficiency of the dye-substrate covalent reaction, and simplifying the post dyeing "soaping off process" traditionally associated with reactive dyes. In addition, the compounds of the present invention provide significantly more intense dyeings, and can be used for both high and low temperature dyeing, hence reducing the cost of the dyeing process. Furthermore, the compounds of the present invention can be used together with specific chromophores for cellulose substrate dyeing leading to significantly reduced levels of salt needed for dyeing.

SUMMARY OF THE INVENTION

According to the present invention there is provided a reactive dye compound comprising:

(a) at least one chromophore moiety;

(b) at least one nitrogen-containing heterocycle;

(c) a linking group to link each chromophore moiety to each nitrogen-containing heterocycle;

characterised in that the nitrogen-containing heterocycle is substituted with at least one thio-derivative and at least one quatemized nitrogen derivative.

The compounds of the present invention exhibit increased Exhaustion (E) and Fixation (F) values and provide improvements in terms of reducing spent dyestuff in effluent, increasing dye affinity to the substrate, increasing the efficiency of the dye-substrate covalent reaction, ability to carry out the dyeing process at room temperature as well as at elevated temperatures, and simplifying the post dyeing "soaping off process" traditionally associated with fiber reactive dyes. In addition, the compounds of the present invention provide significantly more intense dyeings, i.e. greater colour intensity in the dyed substrate.

DETAILED DESCRIPTION OF THE INVENTION

As used herein the term "reactive dye" means a dye containing one or more reactive groups, capable of forming covalent bonds with the substrate to be dyed, or a dye which forms such a reactive group in situ.

As used herein the term "Exhaustion" in relation to reactive dyes means the percentage of dye which is transferred from a solution of the dye to the substrate to be treated at the end of the dyeing process, before rinsing and soaping. Thus 100% Exhaustion means that 100% of the dye is transferred from the dye solution to the substrate.

As used herein the term "Fixation" in relation to reactive dyes means the percentage of dye which covalently bonds with the substrate, based on the dye originally absorbed during the dyeing process. Thus 100% Fixation means that 100% of the dye absorbed is covalently bonded with the substrate.

The compounds of the present invention comprise a chromopbore moiety and a nitrogen-containing heterocycle linked via a linking group. The nitrogen-containing heterocycle has at least one thio-substituent and at least one quatemized nitrogen derivative.

Chromophore Moiety

The reactive dye compounds herein can comprise one or more chromophore moieties. In reactive dye compounds comprising two or more chromophore moieties these can be the same or different. Preferably the reactive dye compounds herein comprise from one to three chromophore moieties.

Any chromophore moieties suitable for use for dyeing substrates can be used in the present invention. The term chromophore as used herein means any photoactive compound and includes any coloured or non-coloured light absorbing species, eg. fluorescent brighteners, UV absorbers, IR absorbing dyes.

Suitable chromophore moieties for use in the dye compounds herein include the radicals of monoazo, disazo or polyazo dyes or of heavy metal complex azo dye derived therefrom or of an anthraquinone, phthalocyanine, formazan, azomethine, dioxazine, phenazine, stilbene, triphenylmethane, xanthene, thioxanthene, nitroaryl, naphthoquinone, pyrenequinone or perylenetetracarbimide dye.

Suitable chromophore moieties for use in the dye compounds herein include those disclosed in EP-A-0,735,107 (Ciba-Geigy), incorporated herein by reference, including the radicals described therein which contain substituents customary for organic dyes, such as sulphonate substituents which enhance the water-soluble properties of the dye compound.

Most preferred chromophore D groups for use herein are polysulphonated azo chromophores such as those present in Procion (RTM) dyes commercially available from BASF, Drimalan (RTM) dyes commercially available from Clariant, Drimarene (RTM) dyes commercially available from Clariant and Levafix (RTM) commercially available from Dystar.

Nitrogen-containing Heterocycle

The reactive dyes of the present invention comprise at least one nitrogen containing heterocyclic moiety. In reactive dye compounds containing two or more nitrogen containing heterocycles these can be the same or different. Preferably the reactive dye compounds herein comprise from one to three nitrogen containing heterocycles. At least one of the nitrogen containing heterocycle moieties herein is substituted with at least one thio-derivative and at least one quaternized nitrogen derivative.

Suitable nitrogen containing heterocycles for use herein include monocyclic, bicyclic or polycyclic, unsaturated heterocycles containing at least one nitrogen heteroatom. When monocyclic rings are used, they are preferably selected from unsaturated rings having from about 3 to about 7 ring atoms, especially 5 or 6 ring atoms, comprising from about 1 to about 3 nitrogen heteroatoms, preferably 2 or 3 nitrogen heteroatoms. When bicyclic heterocycles are used, they preferably comprise an unsaturated nitrogen containing heterocycle having 3 to 7 ring atoms, preferably an unsaturated nitrogen containing heterocycle having 5 or 6 ring atoms comprising 1 or 2 nitrogen atoms, fused to a 5 to 7 membered carbocycle preferably a 6-membered unsaturated carbocycle. When bicyclic heterocycles are used, the thio- and quaternized nitrogen substituents are preferably attached to the nitrogen containing heterocyclic ring.

Preferred for use herein are 5 or 6 membered unsaturated nitrogen containing monocyclic heterocyclic rings comprising 2 or 3 nitrogen heteroatoms or bicyclic rings containing a 5 or 6 membered unsaturated heterocyclic ring containing 2 nitrogen heteroatom fused to a 6 membered unsaturated carbocycle.

Examples of suitable heterocycles for use herein include, but are not necessarily limited to triazine, pyrimidine, quinoxaline, pyrimidinone, phthalazine, pyridazone and pyrazine.

Preferred for use in the compounds herein are triazine, pyrimidine and quinoxaline.

Linking Moiety

The compounds herein further comprise a linking moiety to link each nitrogen-containing heterocycle to each chromophore moiety. Any linking moieties suitable for use in dyeing substrates can be used in the present invention. Preferably the linking moiety is selected from NR, NRC═O, C(O)NR, $NRSO_2$ and —$SO_2NR$ wherein R is H or $C_1$–$C_4$ alkyl which can be substituted by halogen, preferably fluorine or chlorine, hydroxyl, cyano, $C_1$–$C_4$ alkoxy, $C_2$–$C_5$ alkoxycarbonyl, carboxyl, sulfamoyl, sulfo or sulfato. When the heterocycle is a triazine or pyrimidine a preferred linking moiety is NR, preferably where R is H or $C_1$–$C_4$ alkyl, more preferably where R is H or $CH_3$, especially H. When the heterocycle is quinoxaline or phthalazine, a preferred linking moiety is NRC═O, where R is H or $C_1$–$C_4$ alkyl, more preferably where R is H or $CH_3$, especially H.

Suitable thio-derivatives for use herein include, but are not necessarily limited to groups having the formula SR' wherein R' is selected from H or alkyl or preferably short chain alkyl (preferably less than about 6 carbon atoms), alkanol, alkyl carboxylate, alkylamide, alkylsulphonate, alkyl phosphonate, alkyl thiosulphonate, alkylamine, alkyl thiosulphate, aryl sulphonate, aryl carboxylate, aryl phosphate, aryl amine, cyanates, sulphonates, branched alkyl thio carboxylates, branched alkanol thiols, guanides, alkyl-(α-amino-α-carboxylate, (di) thio alkyl esters of glycerol, alkyl thiol alkyl esters of glycerol, alkyl esters, mono thio diesters, thiol alkyl esters of ethylene glycol, alkyl thiol alkyl ester of ethylene glycol and alkyl thiolipoates. Preferably R is selected from alkyl carboxylates and alkanols.

Examples of suitable thio-derivatives include SR' groups where R' is selected from $C_1$–$C_4$ alkyl, $(CH_2)_nCOOH$, $(CH_2)_nCONH_2$, $(CH_2)_nSO_3H$, $(CH_2)_nCOOM$, $(CH_2)_nPO_3H$, $(CH_2)_nOH$, $(CH_2)_nSSO_3^-$, $(CH_2)_nNR''_2$, $(CH_2)_nN^+R''_3$, $PhSSO_3^-$, $PhSO_3H$, $PhPO_3H$, $PhNR''_2$, $PhN^+R''_3$, —CN, $SO_3^-$, $(CH_2)_2CH(SH)R''(CH_2)_3COOH$, —$CH_2CHOHCH_2SH$, and

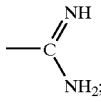

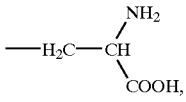

-continued

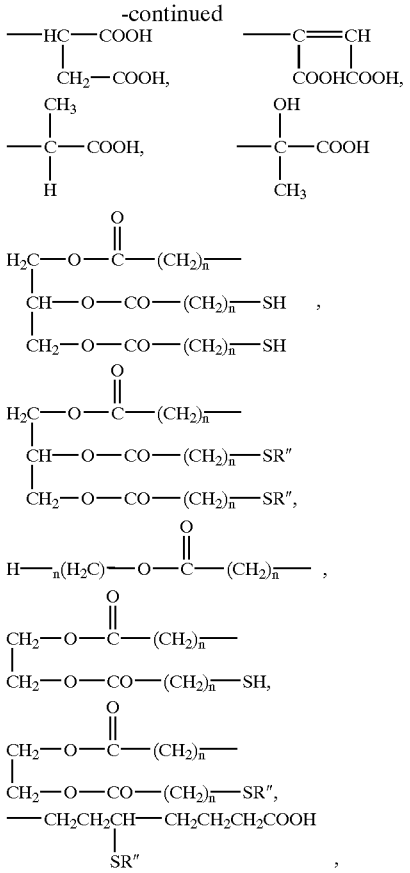

—$CH_2CH_2NH_2$.

n is an integer in the range of 1 to 4 wherein within the same molecule n is not necessarily the same integer; and M is a cation of alkaline earth metal, alkali metal, $NH_4^+$ or $NR''_3^+$ and wherein R" is $C_1$–$C_4$ alkyl.

Preferred thio-derivatives for use herein have the formula SR' wherein R' is (CH2)nCOOH, (CH2)nOH, and (COOH) $CH_2CH_2$(COOH), wherein n is an integer from 1 to 4.

Especially preferred for use herein are thioglycolate (R'=CH2COOH) thioethanol (R'=(CH2)2OH) and succinate (R'=(COOH)$CH_2CH_2$(COOH)), especially thioglycolate.

Suitable quatemized nitrogen derivatives for use herein can be represented by Q+ wherein Q is selected from amines, saturated or unsaturated, substituted or unsubstituted nitrogen containing heterocycles having from about 3 to about 8 ring members and comprising at least one nitrogen heteroatom. Preferred substituents are carboxylates, amides, $C_1$–$C_4$ alkyl and alkyl carboxylates.

Particularly preferred for use herein are Q groups selected from:

$NR''_3$,

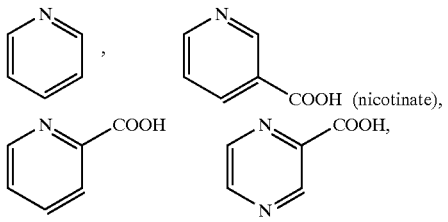

-continued

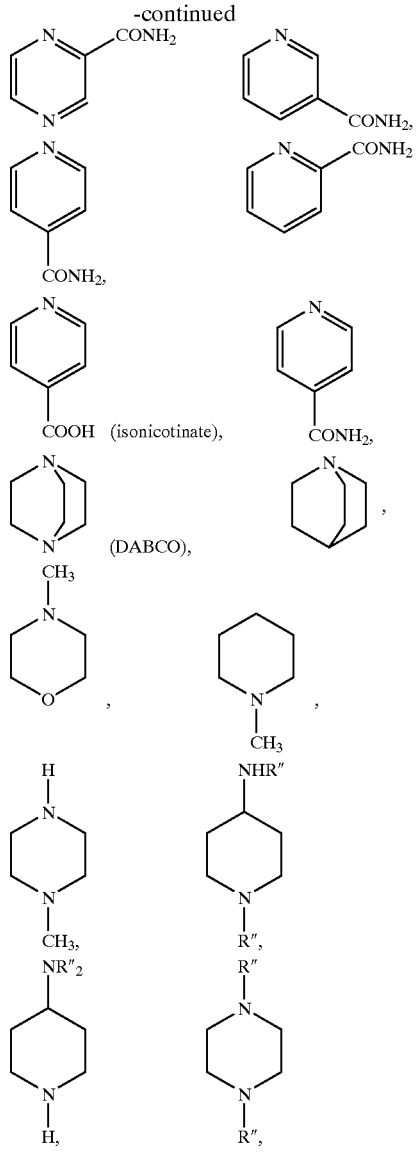

$(CH_3)_2N—NH_2$;

$N(CH_3)_2CH_2COOH$ (dimethylaminobetaine);

$N(CH_3)_2(CH_2)_nNH_2$;

$N(CH_3)_2(CH_2)_nN^+R''_3$;

$N(CH_3)_2CH_2CONH_2$;

wherein R" is $C_1$–$C_4$ alkyl and n is an integer of from 1 to 4.

Particularly preferred quatemized nitrogen derivatives for use herein are nicotinate, diazabicyclooctane (DABCO), dimethylaminobetaine and isonicotinate, especially nicotinate.

The quaternized nitrogen derivative is attached to the nitrogen-containing heterocycle via its tertiary nitrogen atom.

Preferred reactive dye compounds of the present invention may be represented by the following formula (I):

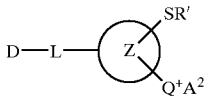

wherein: D is a chromophore group as described hereinabove;

L is a linking moiety as defined herein, preferably selected from NR, NRC=O, NRSO2, wherein R is as defined hereinabove;

Z is a nitrogen containing heterocycle as defined hereinabove;

SR' is a thio-derivative as described hereinabove, $Q^+$ is a quatemized nitrogen derivative as described hereinabove, A is halogen, preferably chlorine or fluorine;

and salts and esters thereof.

Other preferred reactive dye compounds of the present invention can be represented by the formula (II):

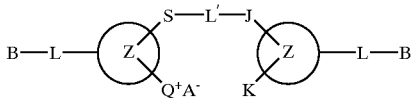

wherein: B is a chromophore D as defined above, bifunctional chromophore, or other organic radical suitable for use in place of a chromophore such as those taught in the art (see for example EP-A-0,735,107), provided that the reactive dye compound contains at least one chromophore group. Suitable B groups included β-sulphatoethylsulphonyl benzene, vinyl sulphonyl benzene, chloroethylsulphonyl benzene, β-s-thiosulphatoethyl sulphonyl benzene, di(ethylsulphonyl) chiomophore L, Z, Q, A are as defined hereinabove;

J is selected from S, O, NH

K is selected from $Q^{30}$ , halogen

L' is a linking group which can be any suitable biradical linking group suitable for use in dye compounds and is preferably selected from B wherein B is as defined above, $C_1$–$C_4$ alkyl, esters having the formula (Al), diesters having the formula (Al), amides having the formula (Al), diamides having the formula (Al) wherein A is $(CH_2)_{0-2}$—(C(O)—J)$_{0-1}$—$(CH_2)_{1-4}$—(J—C(O))$_{0,1}$—$(CH_2)_{0-2}$—(J—C(O))—($C_1$–$C_4$)—(C(O)—J)— where J is O, NH or S;

$C_1$–$C_4$ dialkyl sulphides, $C_1$–$C_4$ dialkylsulphoxides, $C_1$–$C_4$ dialkyl sulphones, $C_1$–$C_4$ dialkyl carboxylates, or groups having the formula:

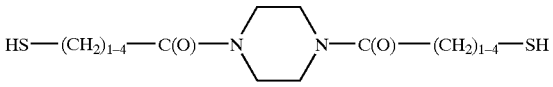

or

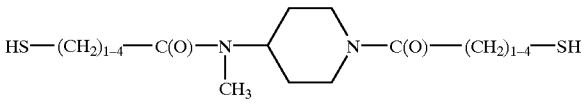

Suitable examples of L' include succinate, diethyl sulphide, β-sulphatoethylsulphonyl benzene, vinyl sulphonyl benzene, chloroethylsulphonyl benzene, β-s-thiosulphatoethyl sulphonyl benzene, di(ethylsulphonyl) chromophore, ethyl, diethylsulphone, isopropanol.

Another preferred reactive dye according to the present invention can be represented by compounds of the formula (III):

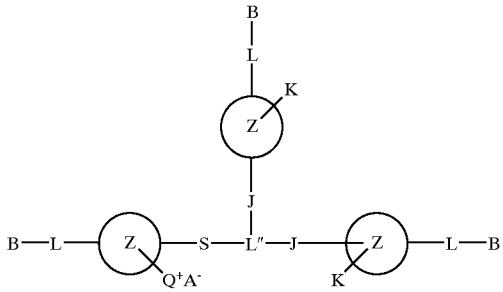

wherein: B, L, Z, Q, J, K and A are as defined above and L" is a linking group which can be any suitable triradical linking group suitable for use in dye compounds and is preferably selected from glycerol, diethylenetriarnine and N,N',N" tripropanoylaminohexahydrotriazine provided that the reactive dye compound comprises at least one chromophore group.

Another preferred reactive dye compound according to the present invention can be represented by compounds of the formula (IV):

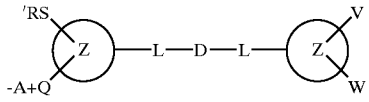

wherein: each of D, L, Z, R', Q are as defined above;

V and W are independently selected from NR, or SR' wherein R and R' are as defined hereinabove, $Q^+$, halogen.

Another preferred reactive dye compound according to the present invention can be represented by compounds of the formula (V):

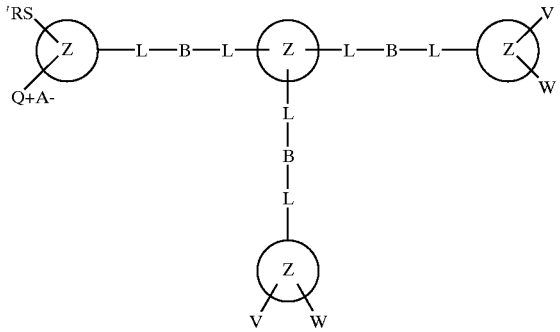

wherein: each of B, Z, Q, A, R', L, V and W are as defined above, provided that the reactive dye compound contains at least one chromophore group.

In the above formulations it is to be noted that within each compound each of the defined groups may be the same or different. For example in formula IV one of the Z groups may be pyrimidine and the other Z group may be triazine.

The present invention furthermore relates to processes for the preparation of dyes herein. In general, dyes having the formula (I) can be prepared by reacting suitable precursors of the dye of formula (I) with one another, at least one of which contains a group D-L-Z, wherein D, L and Z are as defined above, at least one of which contains an R' group (wherein R' is as defined above) and at least one of which contains a Q group (wherein Q is as defined above).

For example, dye compounds of the invention having a formula (I) wherein Z is a triazine heterocycle can be prepared by reacting one mole of dichlorotriazine dye, such as those commercially available from BASF under the tradename Procion (RTM), with a one mole of a suitable reactant containing an SR' group and then reacting the intermediate dye compounds obtained with one mole of a suitable reactant containing a Q group.

Dye compounds of the invention having a formula (I) wherein Z is a pyrimidine heterocycle can be prepared by reacting a difluoromonochloro pyrimidine dye such as those commercially available from Clariant under the tradenames Drimalan F (RTM) and Drimarene R or K (RTM), or a trichloropyrimidine dye such as those commercially available from Clariant under the tradename Drimarene X, with a suitable reactant containing an SR' group and then reacting the intermediate dye obtained with a suitable reactant containing a Q group.

Due to the assymmetric nature of the pyrimidine heterocycle, dye compounds of the invention having a formula (I) wherein Z is a pyrimidine heterocycle can also be prepared by reacting a difluoromonochloropyrimidine dye such as those commercially available from Clariant under the tradenames Drimalan F (RTM) and Drimarene R or K (RTM), or a trichloropyrimidine dye such as those commercially available from Clariant under the tradename Drimarene X, with a suitable reactant containing a Q group and then reacting the intermediate dye obtained with a suitable reactant containing an SR' group.

Dye compounds of the invention having a formula (I) wherein Z is a quinoxaline heterocycle can be prepared by reacting a dichloroquinoxaline dye such as those commercially available from Dystar under the tradename Levofix E (RTM), with a suitable reactant containing an SR' group and then reacting the intermediate dye obtained with a suitable reactant containing a Q group.

The reactions of the starting dye compounds with the reactant containing an SR' group are generally carried out at a pH of from about 7 to about 10, and at a temperature of about 0–5 C. The reactions of the intermediate dye compounds with the reactant containing a Q group are generally carried out at a pH of from about 5 to about 6 and at a temperature of from about 50–85C. In particular, the reactions of the intermediate dye compounds with the reactant containing a Q group are generally carried out at temperature of from about 50–55C when Z is triazine and 75–85 C when Z is pyrimidine.

When Z is pyrimidine, as detailed above, dye compounds of formula (I) can be prepared by reacting the starting dye compounds first with a suitable reactant containing a Q group and then reacting the intermediate dye obtained with a suitable reactant containing an SR' group. In this case, the reactions of the starting dye compound with the reactant containing a Q group are generally carried out at a pH of from about 5 to about 6, and at a temperature of from about 40 to about 50C. The reactions of the intermediate dye compounds with the reactant containing the SR' group are generally carried out at a pH of from about 5 to about 6, and a temperature of from about 50 to about 60C.

In general dyes having the formulae (II)–(V) can be prepared by using the same general chemistry as for dyes of formula (I) by reacting together suitable starting materials, and as exemplified below in Examples 10 to 14.

The dye compounds herein are suitable for dyeing and printing a wide variety of substrates, such as silk, leather, wool, polyamide, polyester fibers and polyurethanes, keratin fibres such as hair, and in particular cellulosic materials, such as the natural cellulose fibres, cotton, linen, hemp and the like, paper, and also cellulose itself and regenerated cellulose, and hydroxyl-containing fibres contained in blend fabrics, for example blends of cotton with polyester or polyamide fibres.

The dye compounds of the present invention can be applied and fixed to the substrate in various ways, in particular in the form of a solid mixture, aqueous dye solutions and printing pastes. Thus according to the present invention there is provided a dye composition comprising one or more of the dye compounds described herein together with any carrier material suitable for use in a dye composition.

Preferred dye compositions herein comprise an acidic buffer material. Any acidic buffer suitable for use in dye compositions can be used herein. An example of a suitable buffer is a mixed phosphate buffer.

When the dye composition herein is in the form of a paste a preferred ingredient is a thickening agent. Any suitable thickening agents suitable for use in dye compositions can be used herein.

When the dye composition is in the form of an aqueous solution or aqueous gel/paste, the dye composition preferably has a pH of about 5 or less, preferably from about 2 to about 3.

When the dye composition is being used for dyeing hair, the composition can comprise one or more of the compounds described herein either alone or in admixture with other well known hair dye compounds such as oxidative dyes, direct dyes, and the like.

The dyeing and printing processes which can be used with the dyes herein are conventional processes which are well known and which have been widely described in the technical and patent literature. The dye compounds herein are suitable for dyeing both by the exhaust method (long liquor) and also by the pad-dyeing method, whereby the goods are impregnated with aqueous, salt-containing or salt-free dye solutions and the dye is fixed after an alkali treatment or in the presence of alkali, if appropriate with the application of heat. The dye compounds herein are also suitable for the cold pad-batch method, after which the dye together with the alkali is applied to the pad-mangle and then fixed by several hours of storage at room temperature. After fixing, the dyeings or prints are thoroughly rinsed with cold and hot water, if appropriate with the addition of an agent acting as a dispersant and promoting the diffusion of the non-fixed portions.

Thus in accordance with another aspect of the present invention there is provided a use of the reactive dyes of the present invention for dyeing and printing substrates such as cotton, wool, nylon, silk, keratin, leather, paper and the like. The compounds herein can be used in methods of dyeing all of the substrates listed above by applying an aqueous solution of one or more of the reactive dyes of the present invention to the substrate to be dyed under suitable conditions of pH and temperature.

The following examples serve to illustrate the compounds and compositions of the present invention.

The starting compounds and components given in the examples below can be used in the form of the free acid or in the form of their salts.

EXAMPLES

Example 1

Synthesis of Monothioglycolatomononicotinyl Triazine Dye using Procion (RTM) Dyes as Starting Materials The monothioglycolatomononicotinyl triazine dye is prepared using the synthesis route as illustrated in Diagram 1.

The synthesis consists of two parts, the first part for the preparation of monochloromonothioglycolato triazine and the second part for the preparation of monothioglycolatomononicotinyl triazine as shown in the recation mechanism below.

Diagram 1

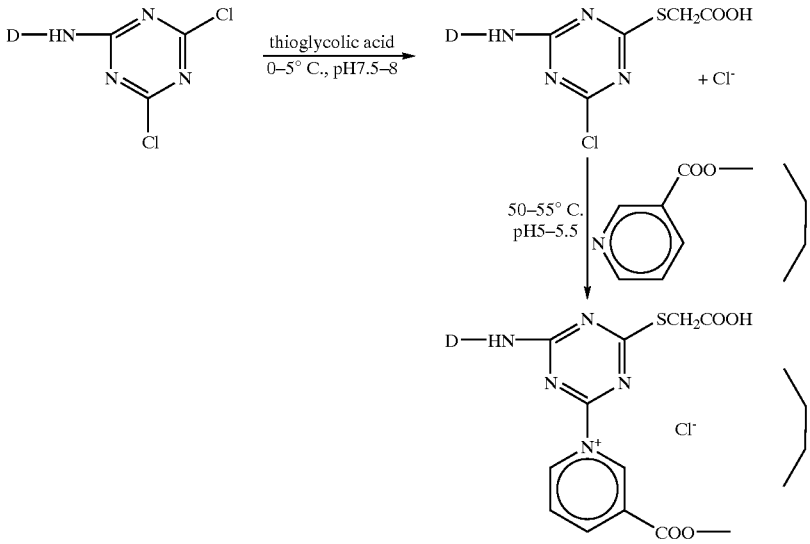

In the reaction scheme D is a chromophore and varies depending on which starting dye is used. In the present example a variety of Procion (RTM) dyes commercially available from BASF were used as starting materials, in particular, Procion Red MX-8B, Procion Yellow MX-8G and Procion Blue MX-2G.

Synthesis of Monochloromonothioglycolato Triazine Dye

The first part of the synthesis is to obtain monochloromonothioglycolato triazine. An aqueous dye solution (0.1 mol/100 ml, pH 7.5) of a purified Procion (RTM) dichlorotriazine dye is prepared. To this solution, a 0.1 mol solution of Mercaptoacetic acid is added by slow dripping at a temperature of between 0 and 5° C. After the addition of mercaptoacetic acid, the pH of the system is adjusted to 8 using sodium carbonate and HCl. The reaction is then allowed to proceed, at 0~5° C. and pH8, for 5~8 hours. For each individual dye, the required reaction time is different (7~8 hours for Procion Red MX-8B, ~6 hours for Procion Yellow MX-8G and ~5 hours for Procion Blue MX-2G). During the synthesis, a rapid pH drop is observed. The end-of-reaction point, for this part of the synthesis, is indicated by the pH of the reaction system remaining constant for more than 5 minutes. At this point, the dye monochloromonothioglycolato triazine is obtained. At the end of the synthesis, the pH of the system is reduced to below pH 2. The solid monochloromonothioglycolato triazine dye compounds is then obtained following precipitation and filtration.

Synthesis of Monothioglycolatomononicotinyl Triazine Dye

In the second part of the synthesis, the monochloromonothioglycolato triazine obtained from the first part of the synthesis is reacted with nicotinic acid. An stoichiometric excess of an aqueous solution of nicotinic acid (pH5~5.5) is added to an aqueous solution of monochloromonothioglycolato triazine dye solution. The temperature of the reaction system is then raised to 50~55° C. and the pH adjusted to 5~5.5. The reaction is allowed to proceed, under these conditions, for a period of time. Again, a rapid drop in pH of the synthesis system is observed. The end-of-reaction point is, again, indicated by the stabilisation of the pH for more nthan 5 minutes. For each individual dye, the required reaction time is different (4~5 hours for Procion Red MX-8B, ~3 hours for Procion Yellow MX-8G and 2~2.5 hours for Procion Blue MX-2G). At this point, the monothioglycolatomononicotinyl triazine dye is obtained.

At the end of the synthesis, the reaction system is immediately cooled to below 5° C. and its pH reduced below 2, in order to prevent the hydrolysis of monothioglycolatomononicotinyl triazine dye. The solid monothioglycolatomononicotinyl triazine dye is then obtained following precipitation and filtration.

The solid monothioglycolatomononicotinyl triazine dye obtained is rinsed with acetone 4~5 times to ensure they are free of water and then stored at 0~5° C.

Example 2

Synthesis of Monothioglycolatomonoisonicotinyl Triazine Dye

The monothioglycolatomonoisonicotinyl traizine dye is prepared using the synthesis route illustrated in Diagram 2.

Diagram 2

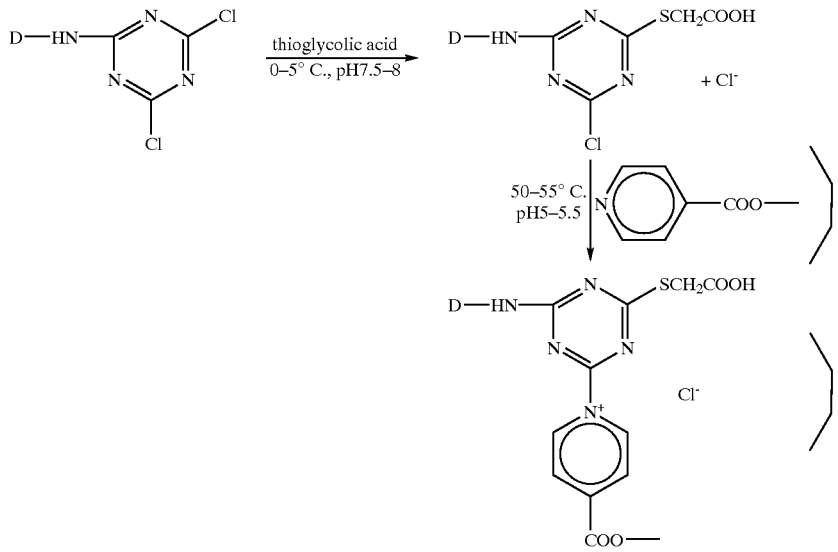

In the reaction scheme D is a chromophore and varies depending on which starting dye is used. In the present example Procion (RTM) Red MX-8B is used as a starting material. The Procion Red MX-8B in this example can be substituted by other dichlorotriazine dyes such as Procion (RTM) Yellow MX-8G or Procion Blue MX-2G.

The synthesis consists of two parts, the first part for the preparation of monochloromonothioglycolatotriazine dye and the second part for the preparation of monothioglycolatomonoisonicotinyl triazine dye.

Synthesis of Monochloromonothioglycolato Triazine Dye

The preparation of monochloromonothioglycolato triazine dye is carried out in the same manner and using the same Procion starting dyes as described in Example 1 above.

Synthesis of Monothioilycolatomonoisonicotinyl Triazine Dye

In the second part of the synthesis, the monochloromonothioglycolato triazine dye obtained from the first part of the synthesis is reacted with iso-nicotinic acid. 0.01 moles of the monochloromonothioglycolato triazine dye obtained from the first part of the synthesis is introduced to a flask containing distilled water together with 0.04 moles of isonicotinic acid. The temperature of the reaction system is then raised to 55° C. and the pH adjusted to 5.5. The reaction is allowed to proceed under these conditions for 30 minutes. Again, a rapid drop in pH of the synthesis system is observed which is adjusted back up to pH 5.5 using buffering agents. The endpoint of the reaction is indicated by the stabilisation of the pH for more than 5 minutes. The conditions of precipitation, filtration and acetone washing are the same as for the compound prepared in Example 1. The yield is over 85%.

Example 3

Synthesis of Monothioglycolatomonodiazabicyclooctane Triazine Dye

The monothioglycolatomonodiazabicyclooctane triazine dye is prepared using the synthesis route as illustrated in Diagram 3.

Diagram 3

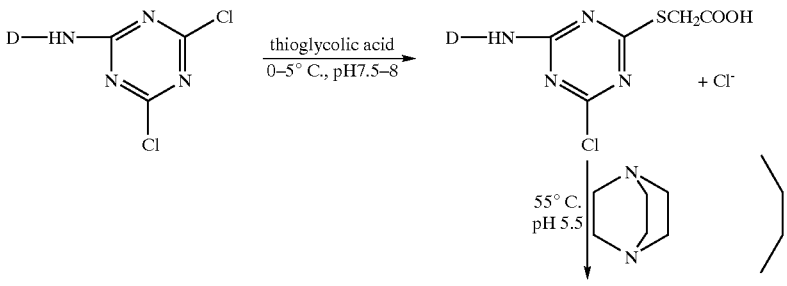

-continued

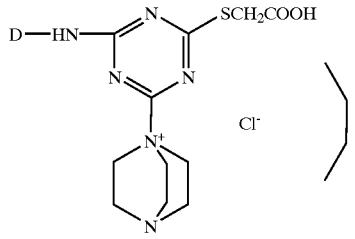

In the reaction scheme D is a chromophore and varies depending on which starting dye is used. In the present example Procion (RTM) Red MX-8B is used as the starting material.

The synthesis consists of two parts, the first part for the preparation of monochloromonothioglycolatotriazine dye and the second part for the preparation of monothioglycolatomonoDABCO triazine dye. The preparation of monochlorothioglycolatotriazine is carried out in the same manner as described in Example 1 above.

In the second part of the synthesis, monochloromonothioglycolato triazine dye obtained from the first part of the synthesis is reacted with diazabicyclooctane (DABCO). 0.01 moles of the monochloromonothioglycolato triazine dye is placed in a flask together with 0.03 moles of DABCO in distilled water. The temperature of the resulting solution is then raised to 55° C. and the pH adjusted to 5.5. The reaction is allowed to proceed under these conditions for 15 minutes. Again, a rapid drop in pH of the synthesis system is observed which can be adjusted using buffering agents. The end-point of the reaction is again indicated by the stabilisation of the pH for more than 5 minutes. The conditions of precipitation, filtration and acetone washing are the same as for Example 1 above. The yield is over 85%.

Example 4

Synthesis of Monothioglycolatomonodimethylaminobetaine Triazine Dye

The monothioglycolatomonodimethylaminobetaine triazine dye is prepared using the synthesis route as illustrated in Diagram 4.

In the reaction scheme D is a chromophore and varies depending on which starting dye is used. In the present example Procion (RTM) Red MX-8B was used as the starting material, but other suitable dichlorotriazine dye compounds can also be used as starting materials such as Procion (RTM) Yellow MX-8G and Procion (RTM) Blue MX-2G.

The synthesis consists of two parts, the first part for the preparation of monochloromonothioglycolatotriazine dye and the second part for the preparation of monothioglycolatomonodimethylaminobetaine triazine dye. The preparation of monochlorothioglycolatotriazine is carried out in the same manner as described in Example 1 above.

In the second part of the synthesis, monochloromonothioglycolato triazine dye obtained from the first part of the synthesis was reacted in aqueous solution with dimethylaminobetaine. 0.01 moles of monochloromonothioglycolato triazine dye is placed in a flask together with 0.03 moles of dimethylaminobetaine and distilled water. The temperature of the reaction system is then raised to 55° C. and the pH adjusted to 5.5. The reaction is allowed to proceed under these conditions for 10 to 15 minutes. A rapid drop in the pH of the synthesis system is observed which can be brought back up to pH 5.5 by using buffering agents. The endpoint of the reaction is indicated by the stabilisation of the pH for more than 5 minutes. The conditions of precipitation, filtration, and acetone washing are the same as for example 1 above. The yield is over 85%.

Diagram 4

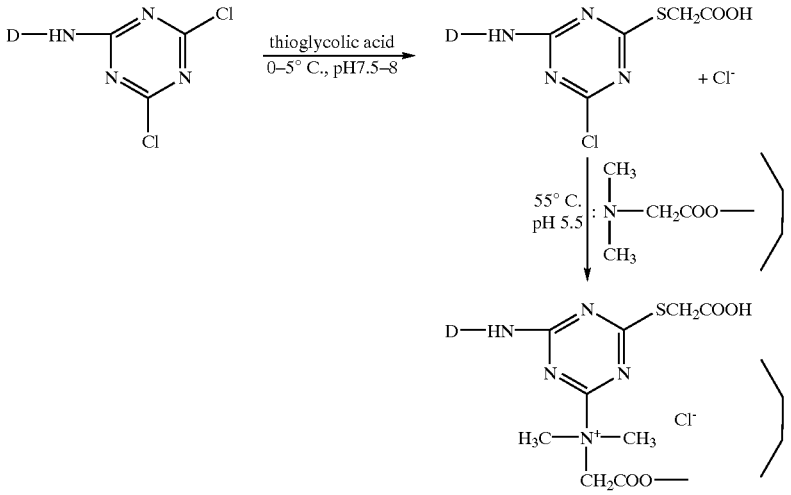

Example 5

Synthesis of Monothioethanolmononicotinyl Triazine Dye

The monothioethanolmononicotinyl triazine dye is prepared using the synthesis route as illustrated in Diagram 5.

Diagram 5

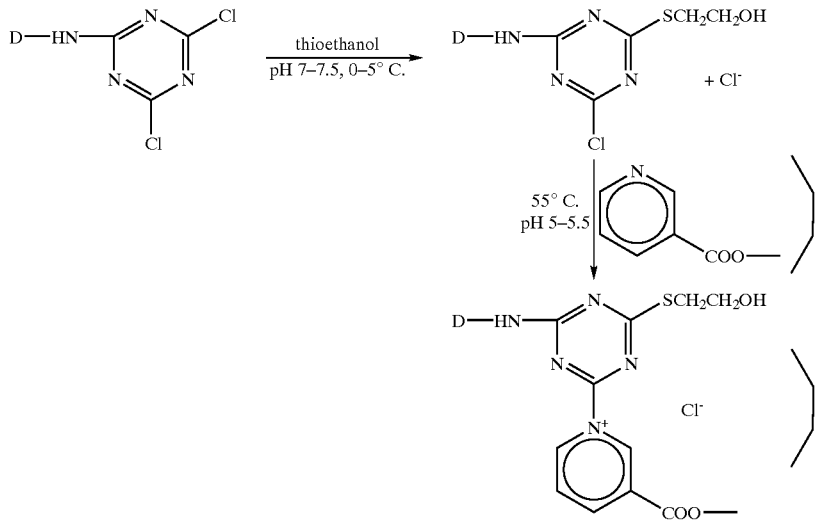

In the reaction scheme D is a chromophore and varies depending on which starting dye is used. In the present example Procion (RTM) Red MX-8G is used as the starting material, but other suitable dichlorotriazine dye compounds can also be used as starting materials such as Procion Yellow MX-8G and Procion Blue MX-2G.

The synthesis consists of two parts, the first part for the preparation of monochloromonothioethanol triazine dye and the second part for the preparation of monothioglycolato-monodimethylaminobetaine triazine dye.

Synthesis of Monochloromonothioethanol Triazine Dye 0.1 mole of Procion Red MX-8G dye is dissolved in distilled water and added to a flask. The flask is placed in an ice-water bath. 0.1 moles of thioethanol is then added drop-wise, to the reaction mixture under stirring. The total addition time is one hour. The pH of the reaction scheme is maintained at pH 7–7.5 and the temperature of the reaction system 0–5° C. during addition of thioethanol. The reaction is then allowed to proceed at 0–5° C. and pH 7.5–8 (which is corrected using sodium carbonate and HCl) for 5 hours.

The endpoint of the reaction is indicated by the pH remaining constant for more than 5 minutes. At this point, the monochloromonothioethanol triazine dye is obtained. Using 6N HCl, the pH of the system is then reduced to below pH2 to terminate the reaction. KCl (35% of the total solution) is then added to the reaction mixture in order to precipitate the dye. Filtration using Whatman filter paper follows. The precipitate is then washed with acetone for 4–5 times (50ml of acetone used each time) to obtain the final dye product.

Synthesis of Monothioethanolmononicotinyl Triazine Dye 0.1 moles of monochloromonothioethanol triazine dye obtained from the above reaction is reacted with 0.3 moles of nicotinic acid in water. The temperature of the reaction system is then raised to 50–55° C. and the pH adjusted to 5–5.5. The reaction is allowed to proceed under these conditions for 30 minutes. Again a rapid drop in pH is observed which can be adjusted using buffering agents. The endpoint of the reaction is again indicated by the stabilisation of the pH for more than 5 minutes. The conditions of precipitation, filtration and acetone washing are the same as above in the first part of the synthesis. The yield is over 85%.

Example 6

Synthesis of Monothiosuccinatemononicotinyl Triazine Dye

The monothiosuccinatemononicotinyl triazine dye is prepared using the synthesis route as illustrated in Diagram 6.

Diagram 6

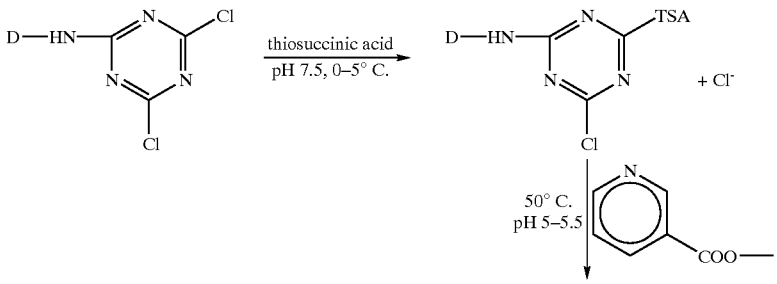

-continued

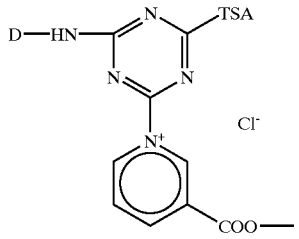

In the reaction scheme D is a chromophore and varies depending on which starting dye is used. In the present example Procion (RTM) Red MX-8G is used as the starting material, but other suitable dichlorotriazine dye compounds can also be used as starting materials, such as Procion (RTM) Yellow MX-8G and Procion (RTM) Blue MX-2G. In the above reactionscheme TSA denotes thiosuccinate attached to the ring via its sulphur atom.

The synthesis consists of two parts, the first part for the preparation of monochloromonosuccinate triazine dye and the second part for the preparation of monosuccinatemononicotinyl triazine dye.

Synthesis of Monochlororomonothiosuccinate Triazine Dye 0.1 moles of pure Procion Red MX-8G dye in distilled water are introduced into a flask. The flask is placed in an ice-water bath. 0.1 moles of thiosuccinic acid is then added dropwise with stirring. The addition time is 1–1.5 hours. The pH of the reaction system is maintained at pH7.5 and the temperature of the reaction system is 0–5° C. throughout the addition of thiosuccinic acid.

The reaction is then allowed to proceed, at 0–5° C. and pH7.5–8 (which was corrected using sodium carbonate and HCl) for 6 hours. The endpoint of the reaction for this part of the synthesis is indicated by the pH of the reaction system remaining constant for more than 5 minutes. At this point, the dye monochloromonothiosuccinate triazine dye is obtained. Using 6N HCl, the pH of the system is then reduced to below pH 2 to terminate the reaction. KCl (35% of the total solution) is then added to the reaction mixture in order to precipitate the dye. Filtration using Whatman paper follows. The precipitate is then washed with acetone for 4–5 times (50 ml of acetone is used each time) to obtain the final dye product.

Synthesis of Monothiosuccinatemononicotinyl Triazine Dye 0.01 moles of the monochloromonothiosuccinate triazine dye obtained from the first part of the synthesis is introduced to a flask together with 0.03 moles of nicotinic acid and distilled water. The temperature of the reaction system is then raised to 50° C. and the pH adjusted to 5–5.5. The reaction is allowed to proceed under these conditions for 15–20 minutes. Again a rapid change in the pH of the synthesis system is observed. The endpoint of the reaction is indicated by the stabilisation of the pH for more than 5 minutes. The conditions of precipitation, filtration and acetone washing are the same as for Example 1. The yield is over 85%.

Example 7

Synthesis of Mono-5-chloro-2-nicotinyl-4-thioglycolato Pyrimidine Dye

The mono5-chloromono4-thioglycolatomono2-nicotinyl pyrimidine dye is prepared using the synthesis route as illustrated in Diagram 7.

Diagram 7

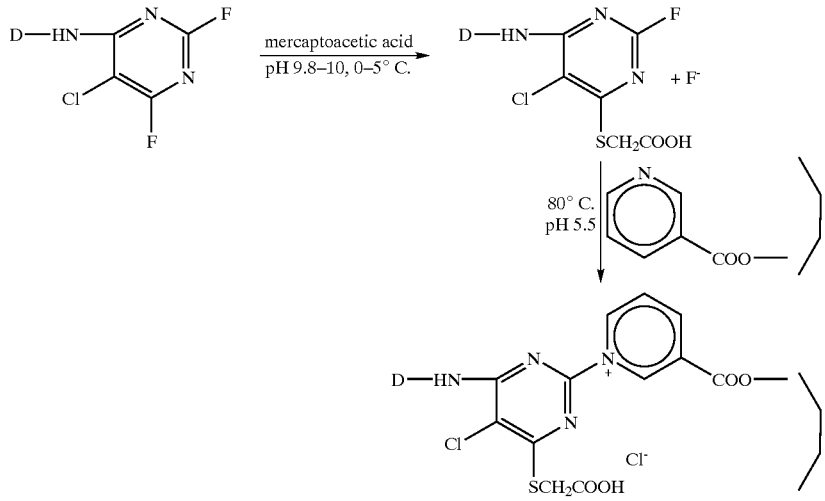

In the reaction scheme D is a chromophore and varies depending on which starting dye is used. In the present example Drimalan (RTM) Red FB dye commercially available from Clariant is used as starting material. However, Drimalan Red FB can be substituted for any suitable difluoromonochloro pyrimidine dye such as those commercially available under the tradename Drimalan and Drimarene dyes, in particular, Drimalan Red FB, Drimalan Yellow F-R, Drimalan Blue F-G, Drimalan Blue F-B, Drimalan Yellow F-3GL, Drimalan Black F-B, Drimarene Golden Yellow R-G2R, Drimarene Blue R-GL, Drimarene Brill Red R-8B, and Drimarene Brill Red K-4BL. The thioglycolato moiety is attached to the ring via its sulphur atom.

The synthesis consists of two parts, the first part for the preparation of mono-5-chloromono-2-fluoromono4-thioglycolato pyrimidine dye and the second part for the preparation of mono-5-chloro-2-nicotinyl-4-thioglycolato pyrimidine dye.

Synthesis of Mono-5-chloromono-2-fluoromono-4-thioglycolato Pyrimidine Dye 0.1 moles of Drimalan Red F-B dye and distilled water are introduced into a flask. The flask is then placed in an ice-water bath. 0.1 moles of mercaptoacetic acid is then added dropwise to the reaction mixture with stirring. The total addition time is 1–1.5 hours.

The pH of the reaction mixture is maintained at pH 9.8–10 and at a temperature of 0–5° C. throughout the addition of mercaptoacetic acid.

The reaction is then allowed to proceed at 5° C. and pH 9.8–10 (which is corrected using sodium carbonate and HCl) for 15 hours. The end-of-reaction point for this part of the synthesis is indicated by the pH of the reaction system remaining constant for more than 5 minutes. At this point, the mono-5-chloro-2-fluoro-mono-4-thioglycolato pyrimidine dye is obtained. Using 6N HCl the pH of the system is then reduced to below pH2 to termninate the reaction. KCl (≈35% of the total solution) is then added to the reaction mixture in order to precipitate the dye. Filtration using Whatman filter paper follows. The precipitate is then washed with acetone for 4–5 times (≈50 ml of acetone used each time) to obtain the mono-5-chloro-2-fluoro-mono-4-thioglycolato pyrimidine dye.

Synthesis of Mono-5-chloro-2-nicotinyl-4-thioglycolato Pyrimidine Dye 0.1 moles of the mono-5-chloro-mono-2-fluoro-4-thioglycolato pyrimidine dye prepared in the first part of the synthesis is dissolved in distilled water together with 0.3 moles of nicotinic acid in a flask. The temperature of the reaction system is then raised to 80±1° C. and the pH adjusted to 5.5. The reaction is allowed to proceed under these conditions for 3–4 hours. Again a rapid change of the pH of the synthesis system is observed. The end point of the reaction is indicated by the stabilisation of the pH for more than 5 minutes. The conditions of precipitation, filtration and acetone washing are the same as in the first part of the synthesis. The yield is over 85%.

Example 8

Synthesis of 5-Chloro-4-nicotinyl-2-thioglycolato Pyrimidine Dye

The 5-chloro-4-nicotinyl-2-thioglycolato pyrimidine dye is prepared using the synthesis route as illustrated in Diagram 8.

Diagram 8

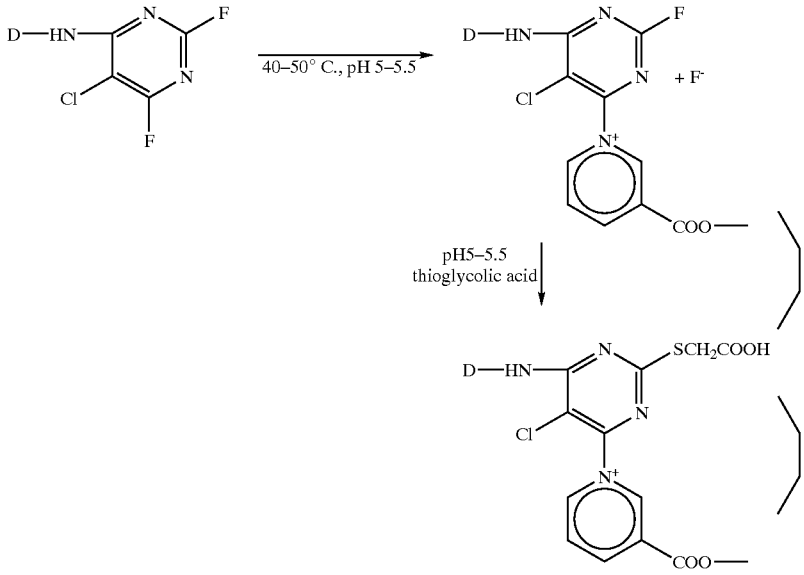

In the reaction scheme D is a chromophore and varies depending on which starting dye is used. In the present example Drimarene Brill Red 4-KBL is used as the starting material. Drimalan Red FB can be substituted for a variety of other suitable difluoromonochloro pyrimidine dyes or trichloro pyrimidine dyes such as those commercially available from Clariant under the tradenames Drimalan and Drimarene, including Drimalan Red F-B, Drimalan Yellow F-R, Drimalan Blue F-G, Drimalan Blue F-B, Drimalan Yellow F-3GL, Drimalan Black F-B, Drimarene Golden Yellow R-G2R, Drimarene Blue R-GL, and Drimarene Brill Red R-8B. In the above reaction scheme the thioglycolato moiety is attached to the ring via its sulphur atom.

The synthesis consists of two parts, the first part for the preparation of 5-chloro-4-nicotinyl-2-fluoro pyrimidine dye and the second part for the preparation of 5-chloro-4-nicotinyl-2-thioglycolato pyrimidine dye.

Synthesis of 5-Chloro-4-nicotinyl-2-fluoro Pyrimidine Dye 0.1 moles of pure Drimarene Brill Red K-4BL dye and distilled water are introduced into a flask. 0.1 moles of nicotinic acid is then added dropwise to the reaction mixture under stirring, from a dripping funnel. The total addition time is 1–1.5 hours. The pH of the reaction system is maintained at pH 5–5.5 and the temperature of the reaction system 40–45° C., throughout the addition of nicotinic acid.

The reaction is then allowed to proceed at 40–45° C. and pH5–5.5 (which is corrected using sodium carbonate and HCl) for 3–4 hours. The end-of-reaction point for this part of the synthesis is indicated by the pH of the reaction system remaining constant for more than 5 minutes. At this point, the 5-chloro-4-nicotinyl-2-fluoro pyrimidine dye is obtained. Using 6N HCl, the pH of the system is then reduced to below pH 2 to terminate the reaction. KCl (≈35% of the total solution) is then added to the reaction mixture in order to precipitate the dye, Filtration using Whatman filter paper follows. The precipitate is then washed with acetone 4–5 time (≈50 ml of acetone is used each time) to obtain the 5-chloro-4-nicotinyl-2-fluoro pyrimidine dye.

Synthesis of 5-Chloro-4-nicotinyl-2-thioglycolato Nyrimidine dye 0.1 moles of the 5-chloro-4-nicotinyl-2-fluoro pyrimidine dye obtained from the first part of the synthesis and 150 ml of distilled water are introduced into a flask. 0.1 mole of mercaptoacetic acid was then added dropwise to the reaction mixture with stirring. The total addition time was 1–1.5 hours. The pH of the reaction scheme is maintained at pH 5–5.5 and the temperature of the reaction system 50–55° C. throughout the addition of mercaptoacetic acid.

The reaction is then allowed to proceed at 50–55° C. and pH 5–5.5 (which is corrected using sodium carbonate and HCl) for 32–35 hours. The end-of-reaction point for this part of the synthesis is indicated by the pH of the reaction system remaining constant for more than 5 minutes. At this point, 5-chloro-4-nicotinyl-2-thioglycolato pyrimidine dye is obtained. Using 6N HCl, the pH of the system is then reduced to below pH 2 to terminate the reaction. KCl(≈35% of the total solution) is then added to the reaction mixture in order to precipitate the dye. Filtration using Whatman filter paper follows. The precipitate is then washed with acetone for 4–5 times (=50 ml of acetone used each time) to obtain the final dye product.

Example 9

Synthesis of Nicotinylthioglycolato Quinoxaline Dye

The nicotinylthioglycolato quinoxaline dye is prepared using the synthesis route as illustrated in Diagram 9.

The synthesis consists of two parts, the first part for the preparation of monothioglycolato quinoxaline dye and the second part for the preparation of monothioglycolato-mononicotinyl quinoxaline dye as shown in the reaction mechanism below.

Diagram 9

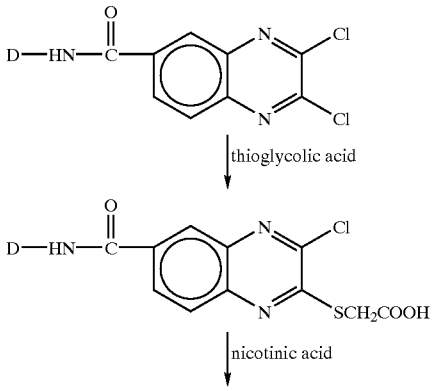

-continued

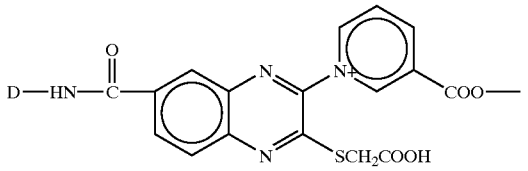

In the reaction scheme D is a chromophore and varies depending on which starting dye is used. In the present example, Levafix Goldgelb E-G commercially available from DyStar is used a starting material but this can be replaced by any suitable quinoxaline dye such as Levafix Brilliant Blue E-B, Levafix Brilliant Red E-RN and Levafix Brown E-2R.

Synthesis of Monothioplycolatoguinoxaline Dye 0.1 moles of pure Levafix Goldgelb E-G dye and distilled water are introduced into a flask. 0.1 moles of mercaptoacetic acid is then added dropwise to the reaction mixture with stirring. The total addition time is 1 hour. The pH of the reaction system is maintained at pH 9 and the temperature of the reaction system 30–35° C. throughout the addition of mercaptoacetic acid.

The reaction is then allowed to proceed at 30–35° C. and pH 9 (which is corrected using sodium carbonate and HCl) for 4–5 hours. The end-of-reaction point for this part of the synthesis is indicated by the pH of the reaction system remaining constant for more than 5 minutes. At this point, thioglycolato quinoxaline dye are obtained. Using 6N HCl, the pH of the system is then reduced to below pH2 to terminate the reaction. KCl (≈35% of the total solution) is then added to the reaction mixture in order to precipitate the dye. Filtration using Whatman filter paper follows. The precipitate is then washed with acetone for 4–5 times (≈50 ml of acetone used each time to obtain the dye product.

Synthesis of Nicotinylthioglycolato Quinoxaline Dye 0.1 moles of the dye obtained from the first part of the synthesis and 0.3 moles of nicotinic acid are dissolved in distilled water in a flask. The temperature of the reaction system is then raised to 50–65° C. and the pH adjusted to 4–4.5. The reaction is allowed to proceed under these conditions for 5–6 hours. Again a rapid change of the pH of the synthesis system is observed. The end-of-reaction point is again indicated by the stabiuisation of the pH for more than 5 minutes. The conditions of precipitation, filtration and acetone washing are the same as above. The yield is over 85%.

Example 10

Synthesis of Compound 10C

The dye denoted by 10C is prepared using the synthesis route as illustrated in Diagram 10.

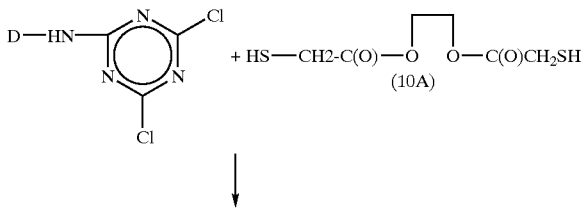

-continued

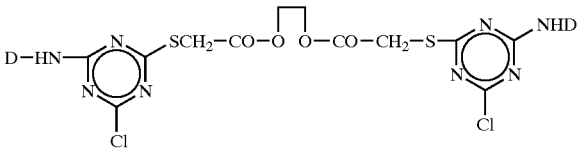

(10B)

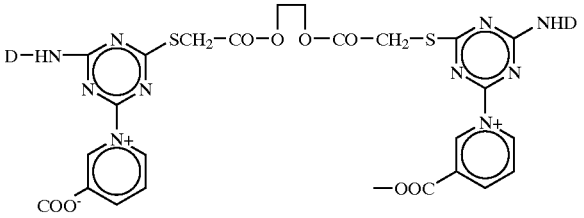

(10C)

Diagram 10

In the reaction scheme D is a chromophore and varies depending on which starting dye is used. In the present example, Procion Red MX-8B commercially available from BASF is used a starting material but this can be replaced by any suitable triazine dye such as Procion Yellow MX-8G and Procion Blue MX-2G.

Synthesis of 10B 0.2 moles of Procion Red MX-8B dye is dissolved in water and reacted with 0.1 moles of ethylene glycol-bis-thioglycolate by stirring at 0–5° C. and maintaining the pH at 7.0 (additions of $NaHCO_3$ as required) for 6 hours (or until the pH remains constant). The product of this reaction is compound 10B .

Synthesis of 10C

Compound 10B is then reacted with 0.3 moles of nicotinic acid at pH 5–5.5 at 50–55° C. for 4 hours (or until the pH remains constant).

At this point the pH of the aqueous dye solution is reduced to 2.0 and the solution cooled to below 5° C. The required dye 10C is filtered off and dried.

Example 11

Synthesis of Dye Compound 11D

Diagram 11

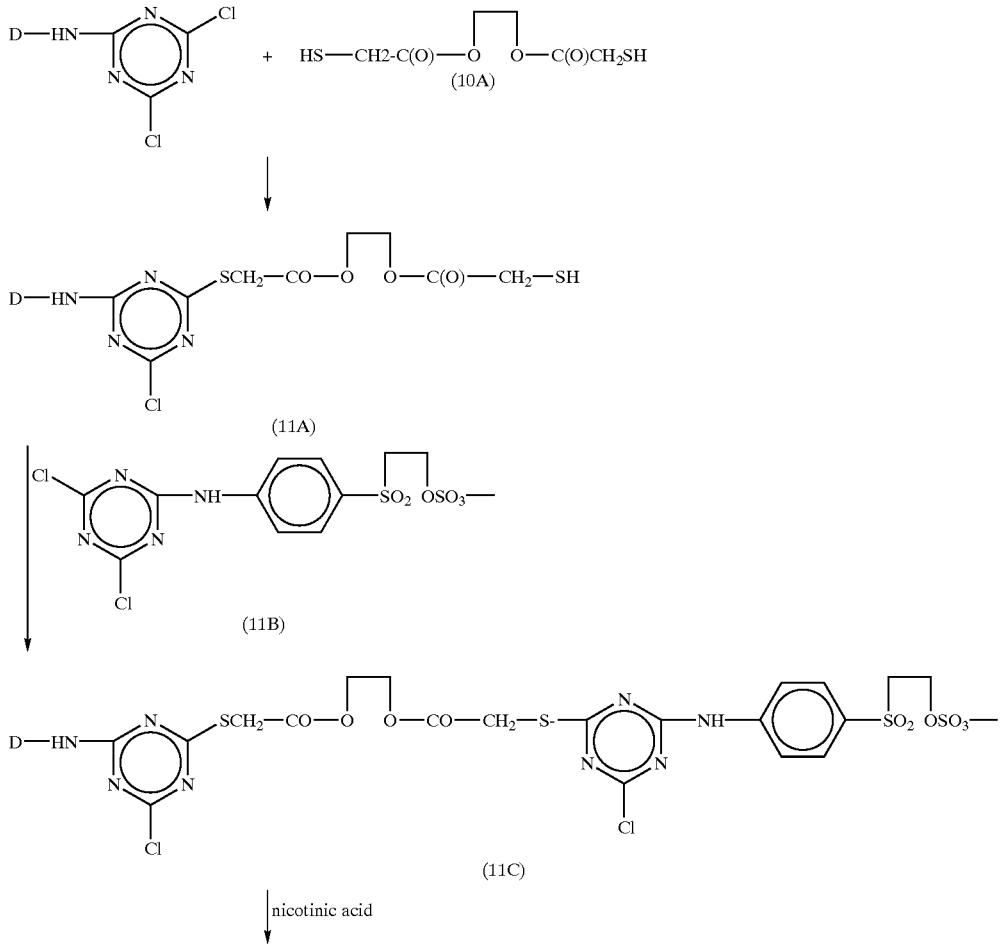

(10A)

(11A)

(11B)

(11C)

-continued

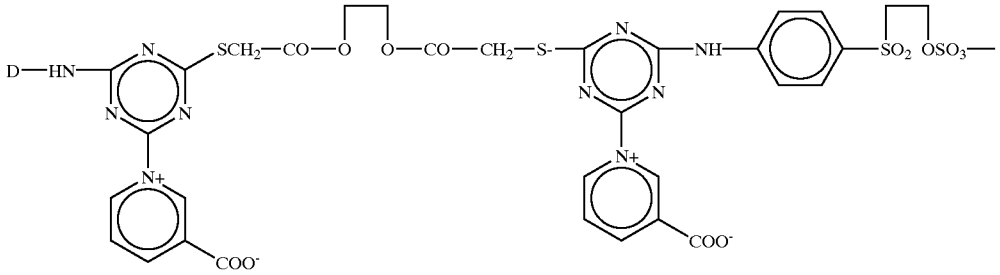

(11D)

In the reaction scheme D is a chromophore and varies depending on which starting dye is used. In the present example, Procion Red MX-8B commercially available from BASF is used a starting material but this can be replaced by any suitable triazine dye such as Procion Yellow MX-8G and Procion Blue MX-2G.

0.1 mole of Procion Red MX-5B is dissolved in water and slowly added to a chilled stirred aqueous solution of 0.1 ethylene glycol-bis-thioglycolate. The solution temperature is 0–5° C. and is maintained at this temperature. The solution is maintained at pH 7 throughout the reaction by the addition of sodium bicarbonate. The intermediate dye 11A is formed when the pH stabilizes.

An aqueous solution of p-aminobenzenesulphatoethylsulphone is prepared and maintained at pH 6–7 and 0–5° C. Cyanuric chloride is then added to this solution to give a compound having the formula (11B):

0.1 mole of compound 11B is then slowly added to an aqueous solution of the intermediate dye 11A, maintaining the pH at 7 and the temperature at 0–5° C. When the pH is stabilized (5–6 hours), the reaction is complete. The product from this reaction (11C) is then reacted with 0.3 moles of nicotinic acid at pH 5–5.5 at 50–55° C. for 5 hours or until the pH remains constant to produce the final dye compound 11D.

Example 12

Synthesis of 12C

The synthesis takes place according to the following reaction mechanism:

Diagram 12

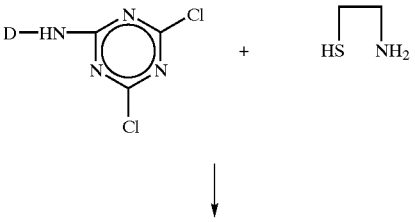

-continued

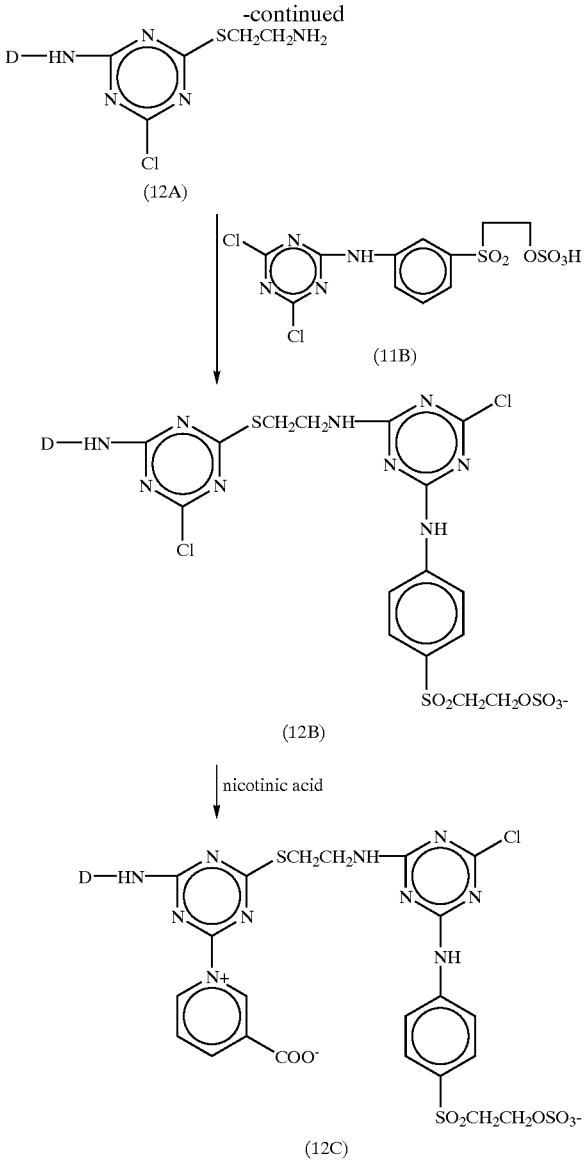

(12A)

(11B)

(12B)

(12C)

Diagram 12

In the reaction scheme D is a chromophore and varies depending on which starting dye is used. In the present example, Procion Yellow MX-8G commercially available from BASF is used a starting material but this can be replaced by any suitable triazine dye such as Procion Red MX-8B and Procion Blue MX-2G.

An aqueous solution of Procion Yellow MX-8G (0.1 mole) is slowly added to an aqueous solution of 0.1 cystamine at pH6 and 0–5° C. The pH is maintained at pH 6 by the addition of $NaHCO_3$. After 4 hours the pH stabilizes and the reaction is complete. Dye intermediate 12A is obtained.

0.1 moles of compound 11B prepared in example 11 is then slowly added to 0.1 moles of aqueous solution of dye 12A at 30° C. and pH7. After 2 hours the pH stabilizes. Quaternization of the resulting product 12B is then carried out by reaction at 50° C. and pH 5 with 0.3 moles of nicotinic acid. The reaction is complete when the pH has stabilized. The final dye 12C is isolated by cooling to 5° C. and filtered off.

Example 13

Synthesis of Compound 13B

The dye compound 13B is synthesised according to the reaction mechanism below.

Diagram 13

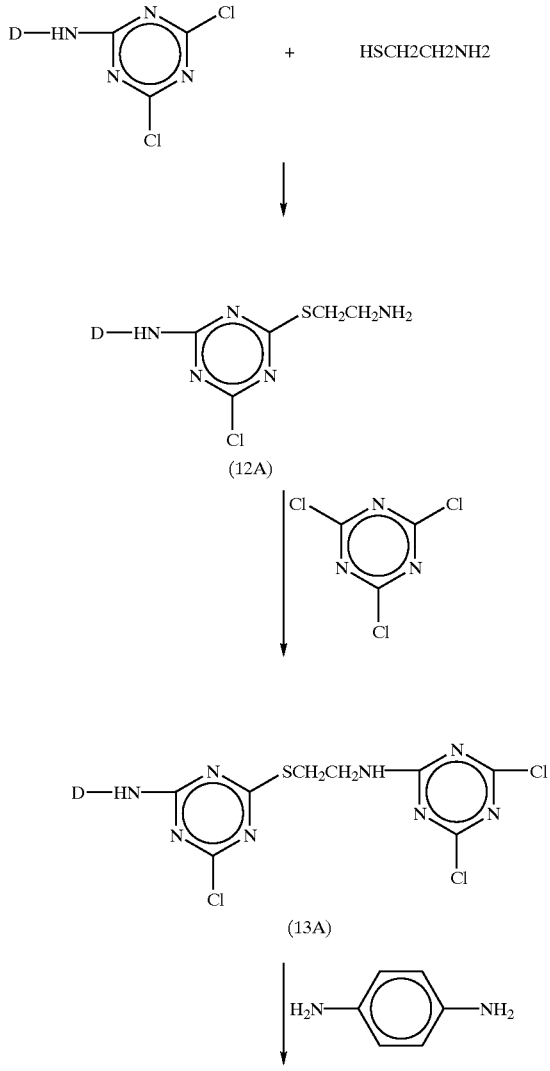

-continued

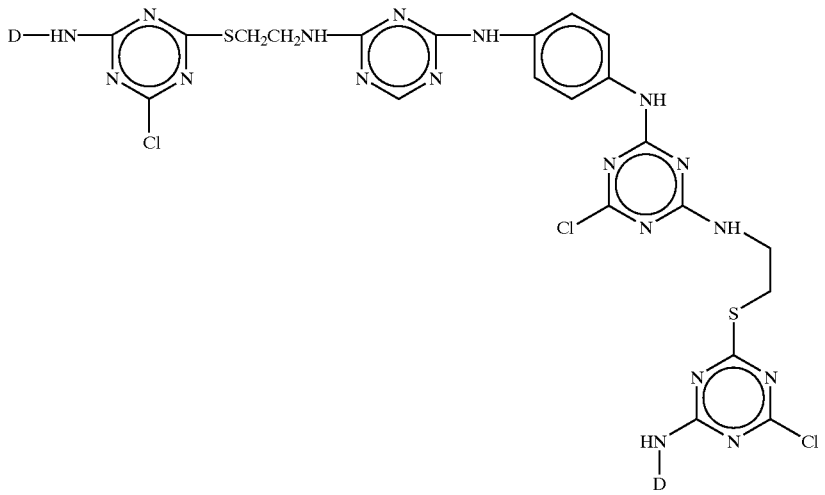

(13B)

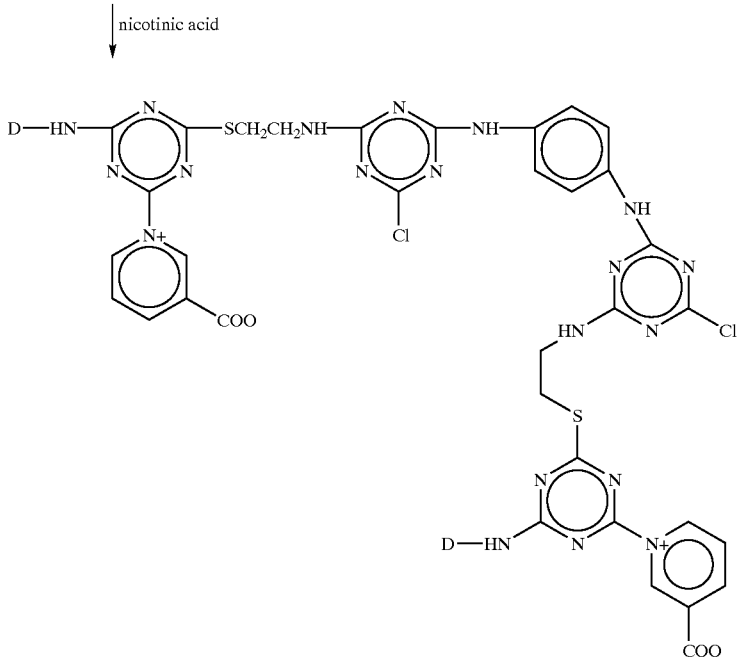

(13C)

Diagram 13

In the reaction scheme D is a chromophore and varies depending on which starting dye is used. In the present example, Procion Yellow MX-8G commercially available from BASF is used a starting material but this can be replaced by any suitable triazine dye such as Procion Red MX-8B and Procion Blue MX-2G.

0.1 moles of cyanuric chloride in acetone was slowly added over 30 minutes to 0.1 moles of compound 12B in aqueous solution at 0–5° C. at pH7. When the pH stabilised the reaction was complete and compound 13A was obtained.

0.1 moles of compound 13A was dissolved in water and added to aqueous solution of p-phenylene diamine (0.05 moles) while maintaining the pH and 6 and temperature at 30° C. After 30 minutes the pH stabilizes and compound 13B is obtained.

0.5 moles of nicotinic acid is then added to an aqueous solution of compound 13B. The pH was maintained at 5 and the temperature at 50° C. After 4 hours the pH was judged to be stabilized and compound 13C was obtained.

Example 14

Compound 14B is prepared by the reaction mechanism below.

Diagram 14

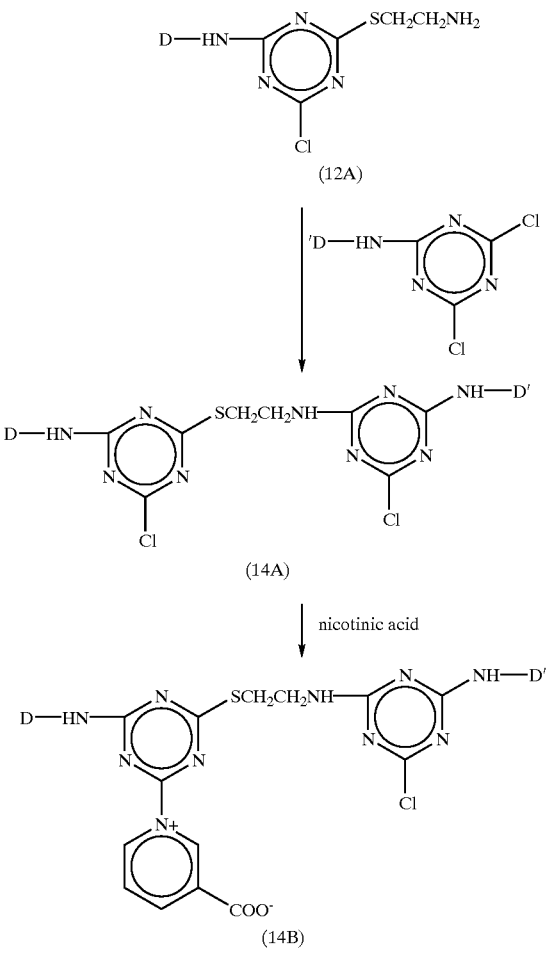

Diagram 14

In the reaction scheme D is a chromophore and varies depending on which starting dye is used. In the present example, Procion Yellow MX-8G commercially available from BASF is used a starting material but this can be replaced by any suitable triazine dye such as Procion Red MX-8B and Procion Blue MX-2G. In the reaction scheme D' is a chromophore and varies depending on which starting dye is used. In the present example, Procion Red MX-8B was used but this can be replaced by any suitable triazine dye.

0.1 moles of Compound 12A is reacted with 0.1 moles of Procion Red MX-8B at pH 7 and 30° C. for 2 hours. The pH is maintained at 7 by the addition of $NaHCO_3$. Compound 14A is obtained.

0.1 moles of Compound 14A is then reacted with 0.2 moles of nicotinic acid at 50° C. and pH5 for 2 hours. When the pH stabilizes compound 14B is produced.

The compounds prepared according to Examples 1 to 14 all have high Exhaustion Values, high Fixation Values, particularly on cellulosic substrates such as cotton, and show significant improvements in terms of reducing spent dyestuff in effluent, increasing dye affinity to the substrate, increasing the dye-substrate covalent bonding, increasesing the ability to dye substrates at room temperature, decreasing the amount of dye that is removed during the post dyeing "soaping off process" and therefore simplying the post dyeing "soaping off process" traditionally associated with dyeing cotton with fibre reactive dyes and reduction of staining of adjacent white fabrics. In addition, the compounds prepared above provide more intense dyeings and require less levels of salt for dyeing cotton substrates. These advantages can be demonstrated by the following Examples 15 and 16.

Example 15

All dye compounds prepared according to Examples 1 to 14 can be used to dye cotton using the dyeing procedures detailed below. After the cotton dyeing procedure has been carried out a soaping-off process can also be carried out on the cotton fibre.

Cotton Dyeing Procedure

An aqueous dye solution is prepared containing a dye compound according to any of Examples 1 to 14. The dye solution contains 1.2% on mass of fibre of dye, 80 g/L $Na_2SO_4$ and 5% on mass of fibre of sodium acetate. The cotton fabrics are soaked in water and then the cotton fabrics are dyed in the above dye-bath at pH 7 at 25° C. for 30 minutes. The dyed cotton fabric is then fixed in the dye-bath at pH 11.5 with addition of 30 g/L of sodium formate and 5 g/L $Na_2CO_3$ and dyeing continued at 25° C. for 30 minutes. The dyed fabric is rinsed with water.

In the above dyeing procedure the dye bath for each dye compound is almost totally exhausted, indicating that the compounds prepared according to Examples 1 to 14 each have a high Exhaustion Value.

Soaping-off Process

A soaping off process can then be carried out by washing the dyed fabrics with an aqueous solution of Sandozine NIE (2 g/L) at 100° C. for 30 minutes.

In the above soaping-off process hardly any colour was removed from the fabric indicating that the compounds prepared according to Examples 1 to 14 each have a high degree of dye-fibre covalent bonding and a high Fixation Value.

Co3 (International Standards Organisation) Wash Fastness Test

The dyed fabrics are washed with an aqueous solution containing ECE Reference Detergent (5 g/ml) and sodium carbonate (2 g/ml) at 60° C. for 30 minutes.

In the above wash fastness test, no noticeable colour was removed from the cotton fibre and no staining of the white adjacent fibres occurred (using Multiple Fibre adjacent strip supplied by SDC Bradford).

Example 16

All dye compounds prepared according to Examples 1 to 14 can be used to dye nylon or wool using the dyeing procedures detailed below. After the nylon/wool dyeing procedure has been carried out a wash-test procedure can be carried out on the dyed fabric to test the wash-fastness of the dye compounds.

Wool/Nylon Dyeing Procedure

The wool/nylon fabric is soaked in a 2% Alcopol-O (40% w/w sodium-d-isooctylsulphate succinate-commercially available from Allied Colloids) solution. The fabric is then dyed for 1 hour at 100° C. and pH 3.5 in a dye-bath containing the following compositions: 1.2% on mass of fibre of dye prepared according to any of Examples 1 to 14, 5% on mass of fibre of sodium acetate, 1% Albegal B (commercially available from Ciba Geigy). The dyed wool/nylon fabric was then rinsed with water.

In the above procedure intense dyeings are provided for each of the compounds prepared according to Examples 1 to 14.

Co2 (ISO) Wash Fastness Test Procedure for Wool/Nylon Fabrics

The dyed wool/nylon fabric is washed in an aqueous solution containing 5 g/L of ECE Reference Detergent (commercially available from Society of Dyers and Colourists, Bradford, UK) at 50° C. for 45 minutes.

In the above wash fastness test, no noticeable colour was removed from the wool fibre and no staining of the white adjacent fibres occurred ((using Multiple Fibre adjacent strip supplied by SDC Bradford).

What is claimed is:

1. A reactive dye compound comprising:

(a) at least one chromophore moiety (b) at least one nitrogen-containing heterocycle (c) a linking group to link each chromophore moiety to each nitrogen-containing heterocycle;

wherein at least one nitrogen-containing heterocycle is substituted with at least one thio-derivative and at least one quaternized nitrogen derivative.

2. A reactive dye compound according to claim 1 wherein the nitrogen-containing heterocycle is selected from triazine, pyrimidine, quinoxaline, phthalazine, pyridazone, and pyrazine.

3. A reactive dye compound according to claim 2 wherein the nitrogen-containing heterocycle is selected from triazine, pyrinudine and quinoxaline.

4. A reactive dye compound according to claim 3 wherein the nitrogen-containing heterocycle is selected from triazine and pyrimidine.

5. A reactive dye compound according to claim 1 wherein the linking group is selected from NR, NRC═O, and NRSO2 where R is selected from H and $C_1$–$C_4$ alkyl,

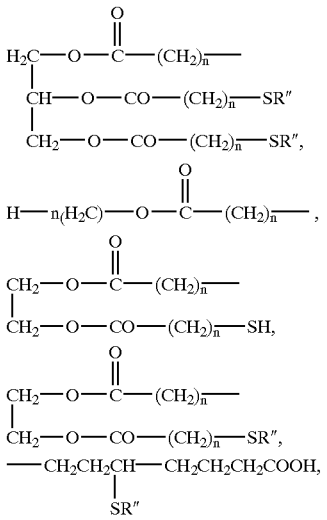

and

—$CH_2CH_2NH_2$.

n is an integer in the range of 1 to 4; and M is a cation of alkaline earth metal, alkali metal, $NH_4^+$ and $NR''_3^+$.

6. A reactive dye compound according to claim 5 wherein the linking group is NR.

7. A reactive dye compound according to claim 6 wherein R is H or $C_1$–$C_4$ alkyl.

8. A reactive dye compound according to claim 1 wherein the thio-substituent is SR' wherein R' is selected from H, $C_1$–$C_4$ alkyl, $(CH_2)_nCOOH$, $(CH_2)_nCONH_2$, $(CH_2)_nSO_3H$, $(CH_2)_nCOOM$, $(CH_2)_nPO_3H$, $(CH_2)_nOH$, $(CH_2)_nSSO_3^-$, $(CH_2)_nNR''_2$, $(CH_2)_nN^+R''_3$, $PhSSO_3^-$, $PhSO_3H$, $PhPO_3H$, $PhNR''_2$, $PhN^+R''_3$, —CN, $SO_3^-$, $(CH_2)_2CH(SH)R''$ $(CH_2)_3COOH$, —$CH_2CHOHCH_2SH$, and

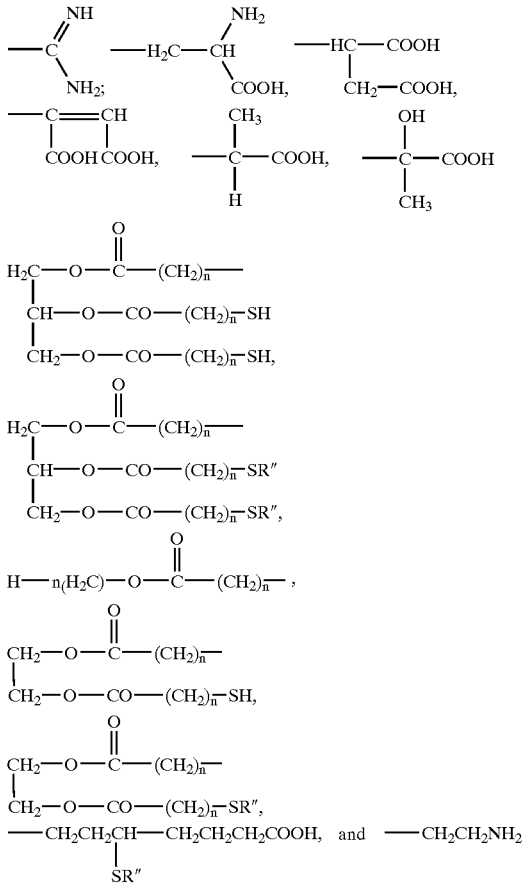

n is an integer in the range of 1 to 4; and M is a cation of alkalino earth metal, alkali metal, $NH_4^+$ or $NR''_3^+$.

9. A reactive dye according to claim 8 wherein R' is selected from $(CH_2)_nCOOH$ or $(CH_2)_nOH$.

10. A reactive dye according to claim 9 wherein R' is $CH_2COOH$.

11. A reactive dye compound according to claim 10 wherein the quaternized nitrogen derivative is Q+ wherein Q is selected from

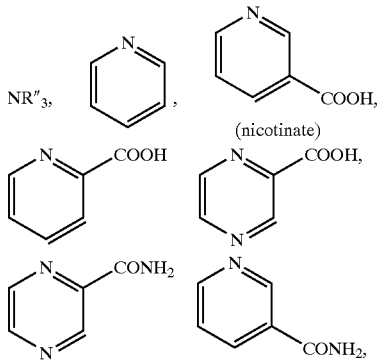

(nicotinate)

-continued

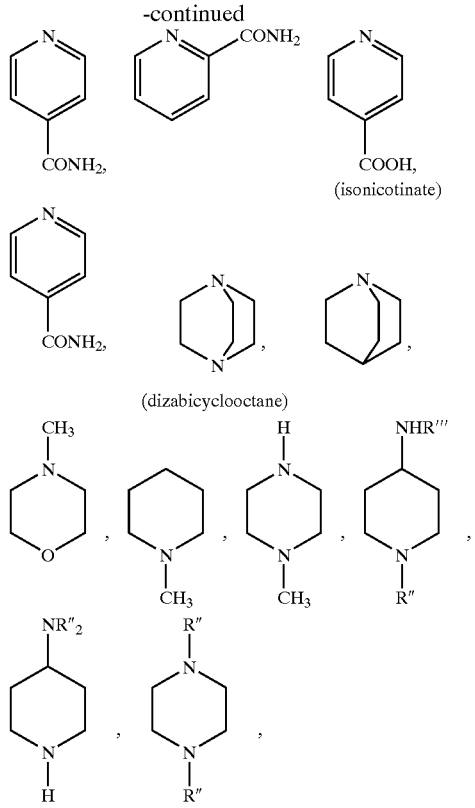

$(CH_3)_2N—NH_2$;

$N(CH_3)_2CH_2COOH$ (dimethylaminobetaine);

$N(CH_3)_2(CH_2)_nNH_2$ $N(CH_3)_2(CH_2)_nN^+R''_3$; and $N(CH_3)_2CH_2CONH_2$;

wherein R" is $C_1$–$C_4$ alkyl and n is an integer of from 1 to 4.

12. A reactive dye according to claim 11 wherein Q is selected from nicotinate, diazabicyclooctane, dimethylaminobetaine and isonicotinate.

13. A reactive dye according to claim 12 wherein Q is nicotinate.

14. A reactive dye compound having the formula:

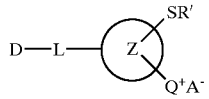

wherein: D is a chromophore group;

L is a linking moiety selected from NR, NRC═O, and NRSO2;

R is H or $C_1$–$C_4$ alkyl;

Z is a nitrogen containing heterocycle;

R' is selected from H, $C_1$–$C_4$ alkyl, $(CH_2)_nCOOH$, $(CH_2)_nCONH_2$, $(CH_2)_nSO_3H$, $(CH_2)_nCOOM$, $(CH_2)_nPO_3H$, $(CH_2)_nOH$, $(CH_2)_nSSO_3^-$, $(CH_2)_nNR''_2$, $(CH_2)_nN^+R''_3$, $PhSSO_3^-$, $PhSO_3H$, $PtIPO_3H$, $PhNR''_2$, $PhN^+R''_3$, —CN, $SO_3^-$, $(CH_2)_2CH(SH)R''(CH_2)_3COOH$, $—CH_2CHOHCH_2SH$, and

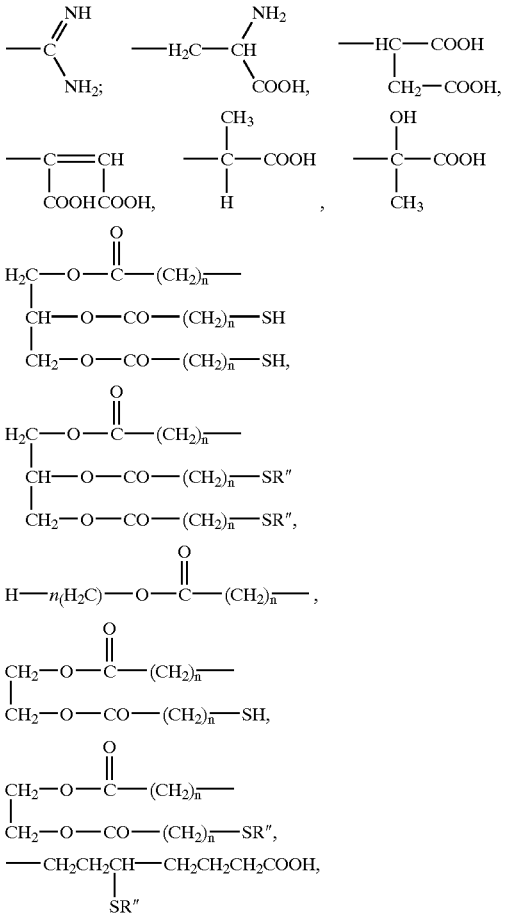

$—CH_2CH_2NH_2$ n is an integer in the range of 1 to 4; and M is a cation of alkaline earth metal, alkali metal, $NH_4^+$ or $NR''_3^+$ Q is selected from

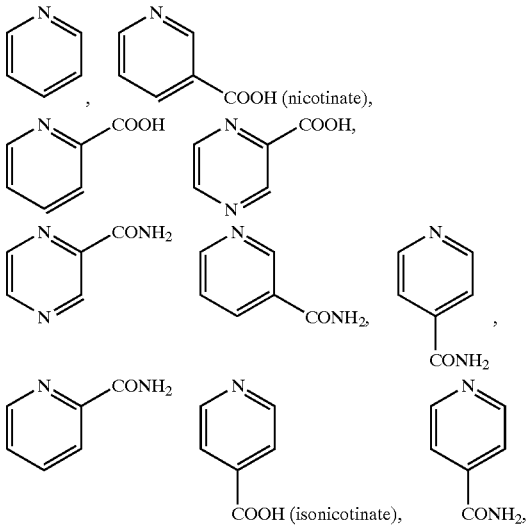

-continued

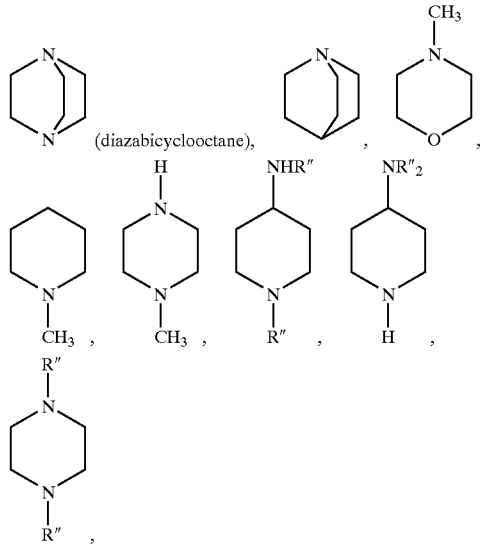

$(CH_3)_2N—NH_2$;

$N(CH_3)_2CH_2COOH$ (dimethylaminobetaine);

$N(CH_3)_2(CH_2)_nNH_2$ $N(CH_3)_2(CH_2)_nN^+R''_3$; and $N(CH_3)_2CH_2CONH_2$;

wherein R" is $C_1$–$C_4$ alkyl and n is an integer of from 1 to 4

A is halogen;

or salts or esters thereof.

15. A reactive dye according to claim 14 wherein Z is selected from triazine, pyrimidine, quinoxaline, phthalazine, pyridazone, and pyrazine.

16. A reactive dye according to claim 15 wherein Z is selected from triazine, pyrmidine and qunoxaline.

17. A reactive dye according to claim 16 wherein Z is triazine.

18. A reactive dye according to claim 17 wherein L is NR, wherein R is H or $C_1$–$C_4$ alkyl.

19. A reactive dye according to claim 18 wherein R' is selected from $(CH_2)_nCOOH$ or $(CH2)_nOH$.

20. A reactive dye according to claim 19 wherein R' is CH2COOH.

21. A reactive dye according to claim 20 wherein Q is selected from nicotinate, diazabicyclooctane, dimethylaminobetaine and isonicotinate.

22. A reactive dye according to claim 21 wherein Q is nicotinate.

23. A reactive dye compound having the formula (II):

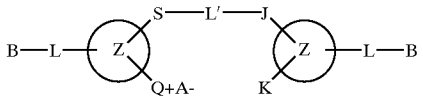

wherein B is a chromophore D or other organic radical suitable for use in place of a chromophore provided that the reactive dye compound contains at least one chromophore group;

L is a linking moiety selected from NR, NRC═O, and NRSO2;

Z is a nitrogen containing heterocycle;

A is halogen;

wherein Q is selected from

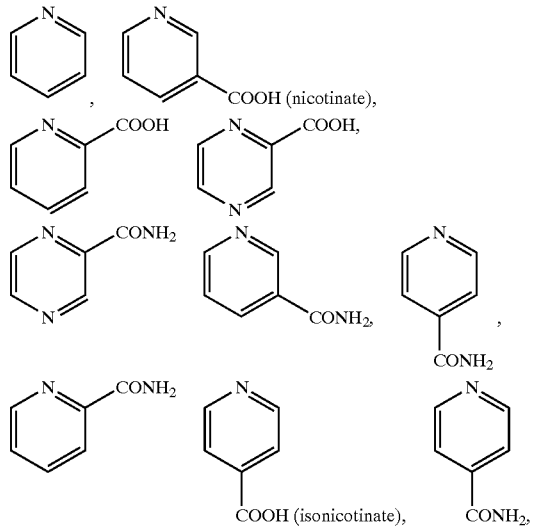

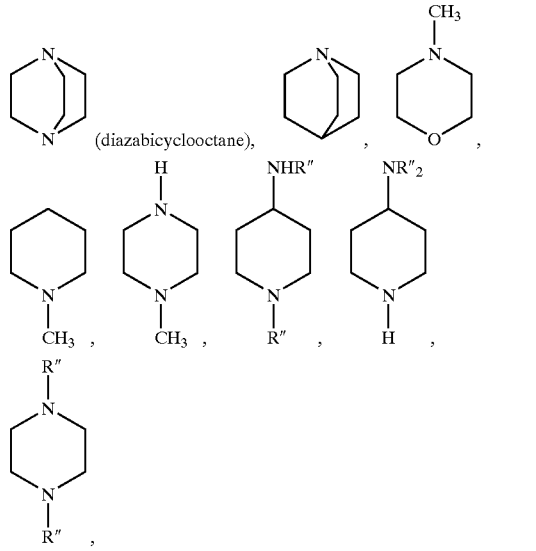

$(CH_3)_2N—NH_2$;

$N(CH_3)_2CH_2COOH$ (dimethylaminobetaine);

$N(CH_3)_2(CH_2)_nNH_2$ $N(CH_3)_2(CH_2)_nN^+R''_3$; and $N(CH_3)_2CH_2CONH_2$;

J is selected from S, O, andNH

K is selected from $Q^+$ and halogen

L' is a linking group which may be any suitable biradical linking group suitable for use in dye compounds and is selected from B wherein B is C1–C4 alkyl, C1–C4 dialkyl sulphide, C1–C4 dialkylsulphoxide, C1–C4 dialkyl sulphone, C1–C4 dialkyl carboxylate, and a group having the formula:

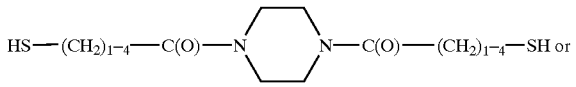

-continued

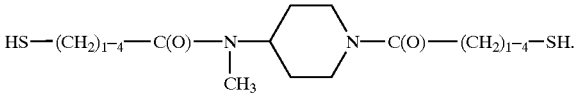

24. A reactive dye compound having the formula (III):

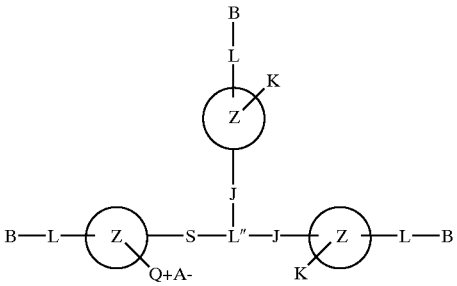

wherein:

B is a chromophore D or other organic radical suitable for use in place of a chromophore provided that the reactive dye compound contains at least one chromophore group;

L is a linking moiety selected from NR, NRC═O, and NRSO2;

Z is a nitrogen containing heterocycle;

A is halogen;

J is selected from S, O, and NH

K is selected from $Q^+$ and halogen wherein Q is selected from

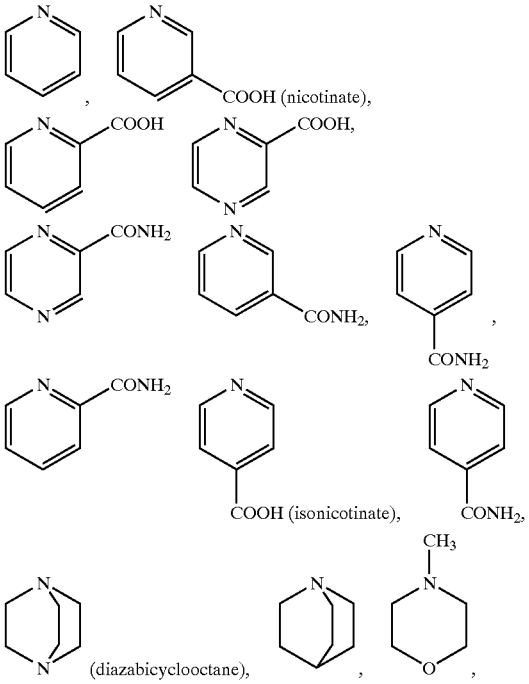

-continued

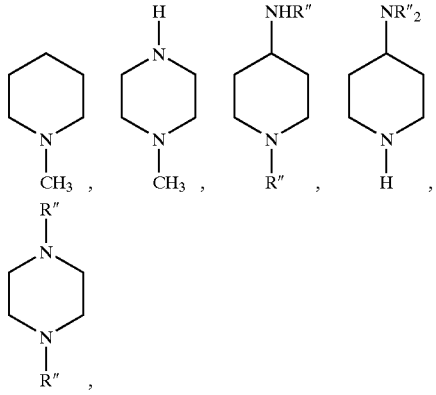

$(CH_3)2N—NH_2$;

$N(CH_3)_2CH_2COOH$ (dimethylaminobetaine);

$N(CH_3)_2(CH_2)_nNH_2$ $N(CH_3)_2(CH_2)_nN^+R''_3$; and $N(CH_3)_2CH_2CONH_2$;

L" is a linking group which may be any suitable triradical linking group suitable for use in dye compounds and is selected from glycerol and diethylenetriamine, provided that the reactive dye compound comprises at least one chromophore group.

25. A reactive dye compound having a formula (IV):

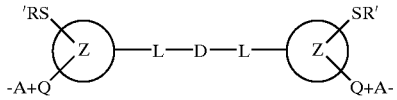

wherein:

L is a linking moiety selected from NR, NRC═O, and NRSO2;

A is halogen

Z is a nitrogen containing heterocycle;

D is a chromophore group

R' is selected from H, $C_1$–$C_4$ alkyl, $(CH_2)_nCOOH$, $(CH_2)_nCONH_2$, $(CH_2)_nSO_3H$, $(CH_2)_nCOOM$, $(CH_2)_nPO_3H$, $(CH_2)_nOH$, $(CH_2)_nSSO_3^-$, $(CH_2)_nNR''_2$, $(CH_2)_nN^+R''_3$, $PhSSO_3^-$, $PhSO_3H$, $PhPO_3H$, $PhNR''_2$, $PhN^+R''_3$, —CN, $SO_3^-$, $(CH_2)_2CH(SH)R''$ $(CH_2)_3COOH$, $—CH_2CHOHCH_2SH$, and

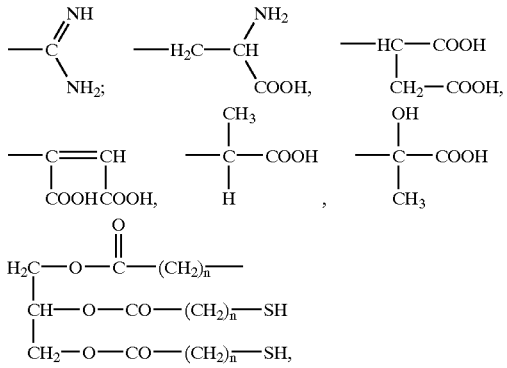

-continued

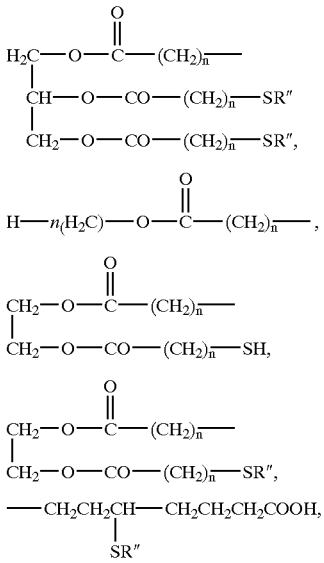

and $—CH_2CH_2NH_2$ wherein Q is selected from

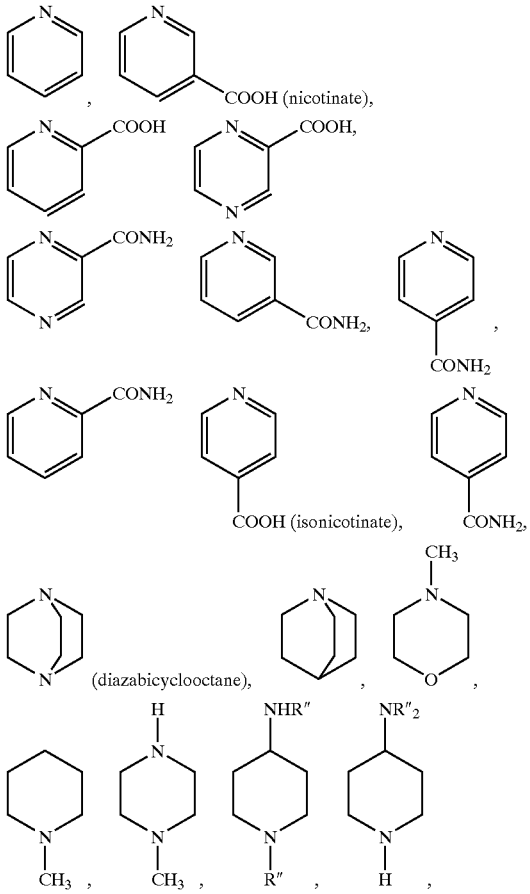

-continued

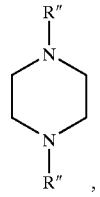

$(CH_3)_2N—NH_2$;

$N(CH_3)_2CH_2COOH$ (dimethylaminobetaine);

$N(CH_3)_2(CH_2)_nNH_2$ $N(CH_3)_2(CH_2)_nN^+R''_3$; and $N(CH_3)_2CH_2CONH_2$.

26. A reactive dye compound having a formula (V):

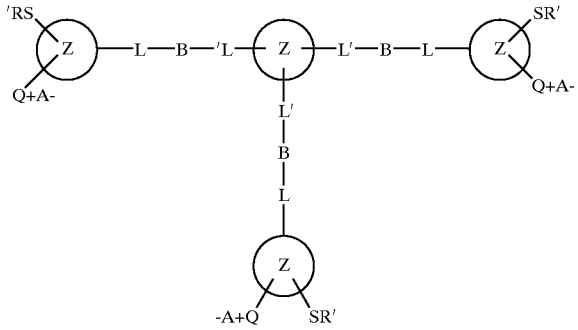

wherein

L is a linking moiety selected from NR, NRC═O, and NRSO2;

A is halogen

Z is a nitrogen containing heterocycle;

B is a chromophore D or other organic radical suitable for use in place of a chromophore provided that the reactive dye compound contains at least one chromophore group L' is a linking group which may be any suitable biradical linking group suitable for use in dye compounds and selected from B wherein B is as defined above, C1–C4 alkyl, C1–C4 dialkyl sulphide, C1–C4 dialkylsulphoxide, C1–C4 dialkyl sulphone, $C_1$–$C_4$ dialkyl carboxylate, or a group having the formula:

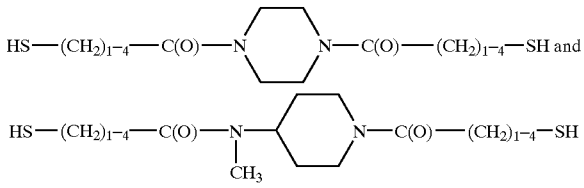

R' is selected from R' is H, $C_1$–$C_4$ alkyl, $(CH_2)_nCOOH$, $(CH_2)_nCONH_2$, $(CH_2)_nSO_3H$, $(CH_2)_nCOOM$, $(CH_2)_nPO_3H$, $(CH_2)_nOH$, $(CH_2)_nSSO_3^-$, $(CH_2)_nNR''_2$, $(CH_2)_nN^+R''_3$, $PhSSO_3^-$, $PhSO_3H$, $PhPO_3H$, $PhNR''_2$, $PhN^+R''_3$, —CN, $SO_3^-$, $(CH_2)_2CH(SH)R''(CH_2)_3COOH$, $—CH_2CHOHCH_2SH$, and

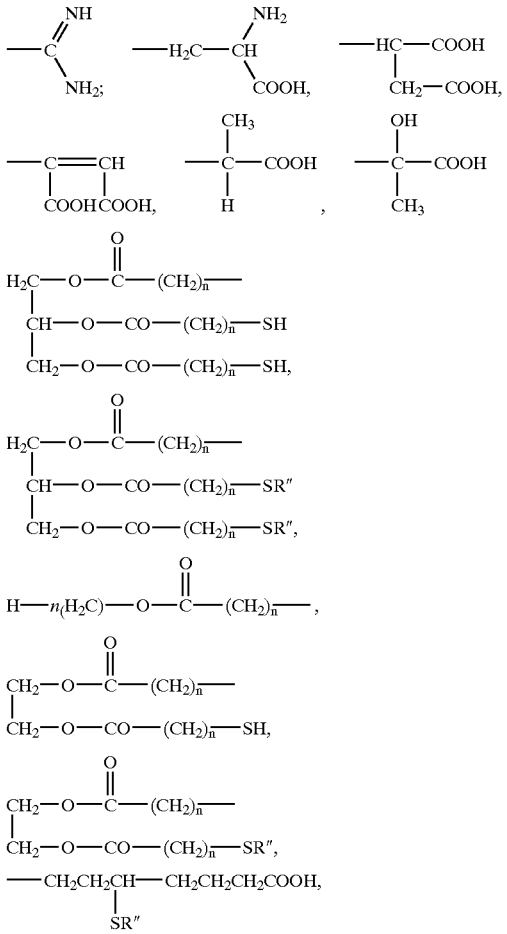

and $—CH_2CH_2NH_2$ wherein Q is selected from

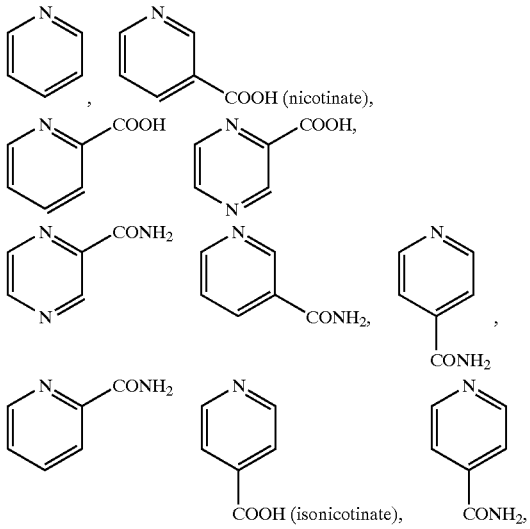

-continued

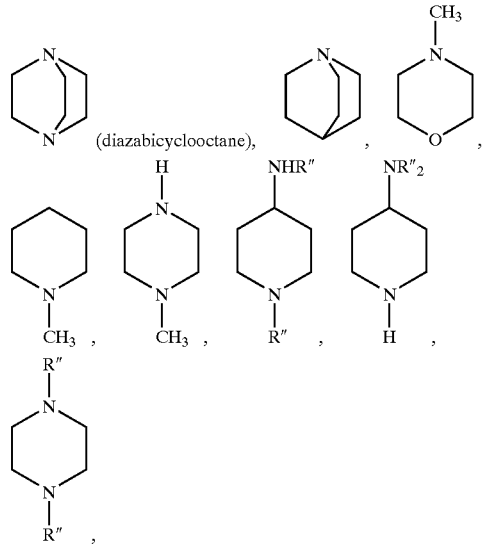

$(CH_3)_2N—NH_2$;

$N(CH_3)_2CH_2COOH$ (dimethylaminobetaine);

$N(CH_3)_2(CH_2)_nNH_2$ $N(CH_3)_2(CH_2)_nN^+R''_3$; and $N(CH_3)_2CH_2CONH_2$, provided that the reactive dye compound contains at least one chromophore group.

27. A dye composition comprising one or more reactive dye compounds of claim 1.

28. A dye composition according to claim 27 wherein the composition is in the form of a solid mixture and further comprises an acid buffer.

29. A dye composition according to claim 27 wherein the composition is in the form of a liquid and further comprises water and an acid buffer.

30. A dye composition according to claim 27 wherein the composition is in the form of a paste and further comprises water, thickening agent and an acid buffer.

31. A dye composition according to claim 27 wherein the pH is 5 or less.

32. A dye composition according to claim 31 wherein the pH is from about 2 to about 3.

33. A reactive dye compound according to claim 7 wherein R is H.

34. A reactive dye according to claim 17 wherein L is NR, wherein R is H.

35. A reactive dye compound having the formula:

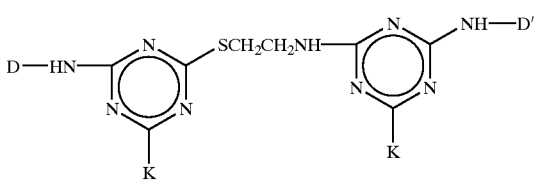

wherein: D and D' are chromophore groups; and

K is selected from $Q^+$ and halogen, wherein $Q^+$ is a quaternized nitrogen derivative.

36. A reactive dye compound having the formula:

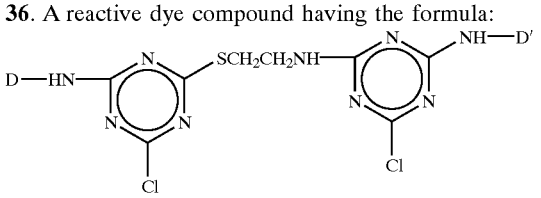

wherein D and D' are chromophore groups.

37. A method for dyeing and printing textiles, comprising the steps of 1) applying the reactive dye composition of claim 27 to a textile, 2) rinsing the textile.

38. A method for dyeing and printing keratin, comprising the steps of 1) applying the reactive dye composition of claim 27 to keratin, 2) rinsing the keratin.

* * * * *